US005673571A

United States Patent [19]

Manley

[11] Patent Number: 5,673,571

[45] Date of Patent: Oct. 7, 1997

[54] DEETHANIZER/DEPROPANIZER SEQUENCES WITH THERMAL AND THERMO-MECHANICAL COUPLING AND COMPONENT DISTRIBUTION

[76] Inventor: David B. Manley, 11480 Cedar Grove Rd., Rolla, Mo. 65401

[21] Appl. No.: 611,342

[22] Filed: Mar. 6, 1996

[51] Int. Cl.[6] ..... F25J 3/02

[52] U.S. Cl. ..... 62/630; 62/631

[58] Field of Search ..... 62/630, 631

[56] References Cited

U.S. PATENT DOCUMENTS

| | | | |
|---|---|---|---|
| 1,735,558 | 11/1929 | Youker . | |
| 2,277,387 | 3/1942 | Carney . | |
| 2,327,643 | 8/1943 | Houghland . | |
| 2,487,147 | 11/1949 | Latchum, Jr. . | |
| 2,666,019 | 1/1954 | Winn et al. . | |
| 2,952,983 | 9/1960 | Gilmore | 62/631 |
| 3,313,724 | 4/1967 | Kniel | 62/631 |
| 4,251,249 | 2/1981 | Gulsby . | |
| 4,285,708 | 8/1981 | Politte et al. . | |
| 4,411,676 | 10/1983 | Tedder | 62/631 |
| 4,705,549 | 11/1987 | Sapper . | |
| 4,710,213 | 12/1987 | Sapper et al. | 62/631 |
| 4,759,786 | 7/1988 | Atkinson et al. | 62/631 |
| 5,435,436 | 7/1995 | Manley et al. . | |

FOREIGN PATENT DOCUMENTS

| | | | |
|---|---|---|---|
| 7007761 | 2/1982 | Japan | 62/630 |
| 0581952 | 11/1977 | U.S.S.R. | 62/631 |
| 2110808 | 6/1983 | United Kingdom | 62/630 |

OTHER PUBLICATIONS

"Temperature–Heat Diagrams for Complex Columns, 2. Underwood's Method for Side Strippers and Enrichers" (N.A. Carlberg et al, Ind. Eng. Chem. Res., vol. 28, pp. 1379–1386, 1989).

*Primary Examiner*—Christopher Kilner

[57] ABSTRACT

The present invention is a set of improvements in deethanizing and depropanizing fractionation steps in NGL processing. The several embodiments of the present invention apply component distribution to multiple columns, interreboiling, intercondensing, thermal coupling and "thermo-mechanical" coupling to the commonly practiced deethanizer/depropanizer fractionation sequence of NGL processing.

31 Claims, 23 Drawing Sheets

FIGURF 2B
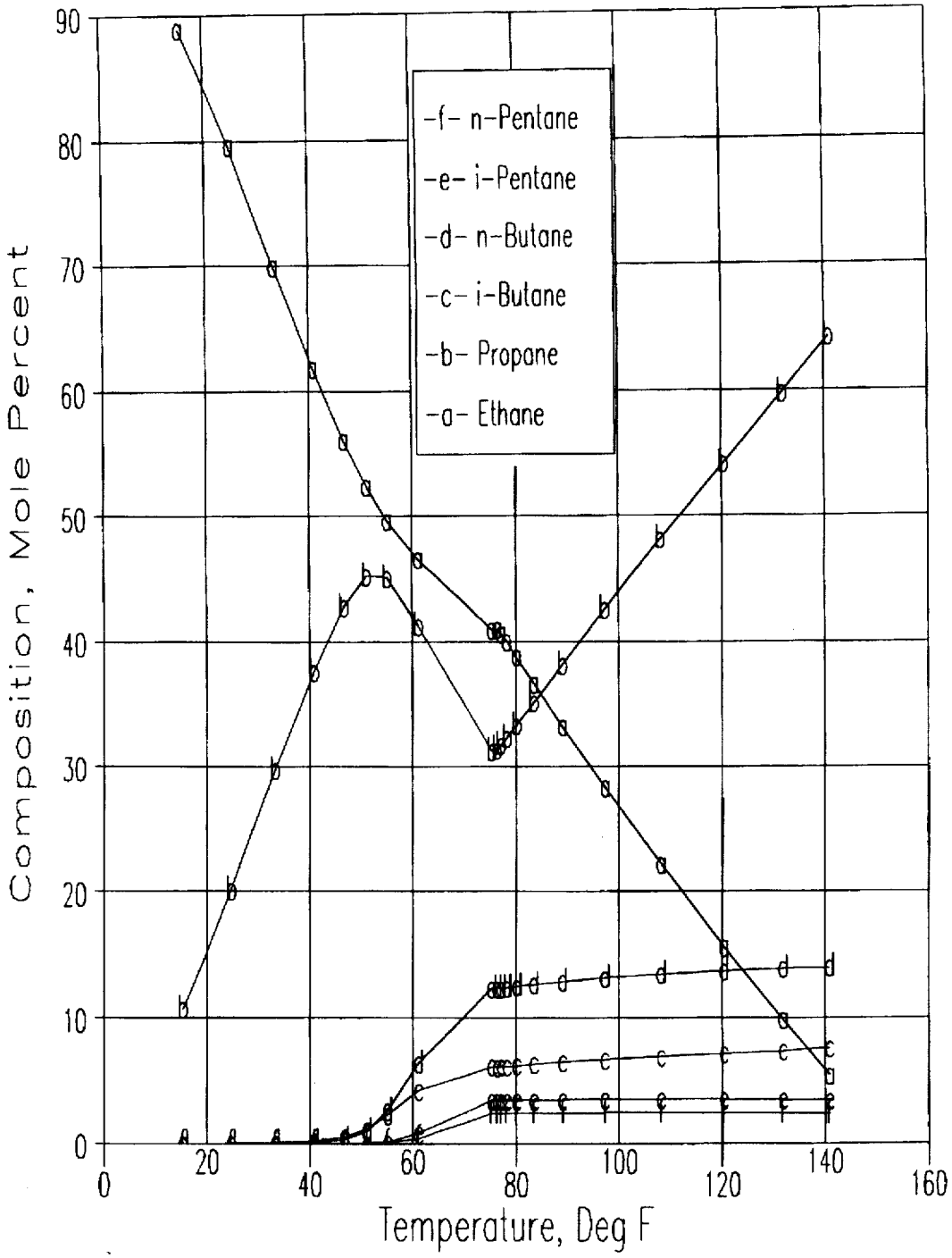

FIGURF 2C
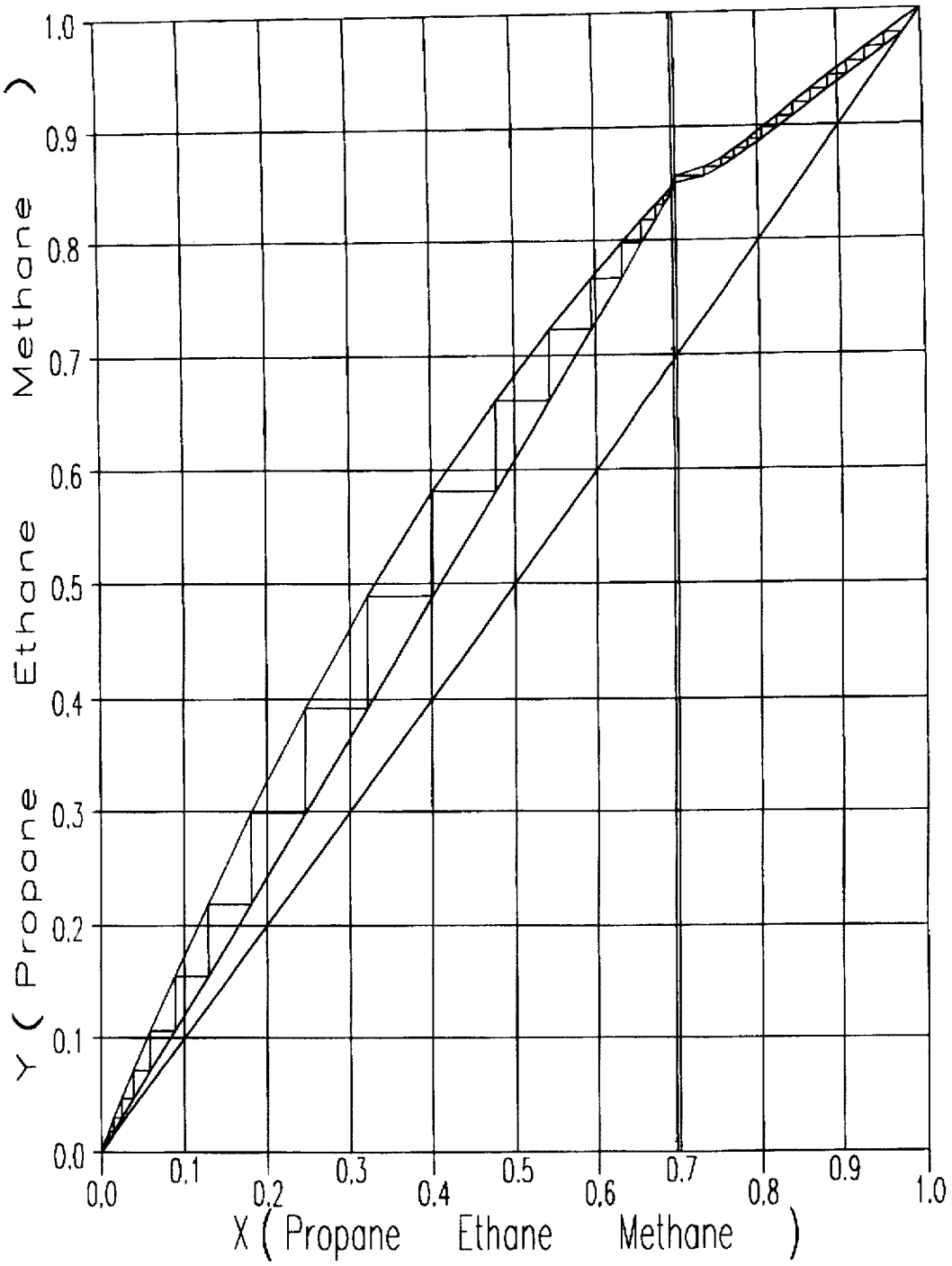

CONVENTIONAL HEAT INTEGRATED DEETHANIZER
MCCABE-THIELE DIAGRAM

DEETHANIZER/DEPROPANIZER SEQUENCES WITH THERMAL AND THERMO-MECHANICAL COUPLING AND COMPONENT DISTRIBUTION

BACKGROUND OF THE INVENTION

The present invention relates to NGL fractionation, especially to the deethanizer/depropanizer fractionation sequence.

In the article "Temperature-Heat Diagrams for Complex Columns, 2. Underwood's Method for Side Strippers and Enrichers" (N. A. Carlberg et al, Ind. Eng. Chem. Res., vol. 28, pp. 1379–1386, 1989), complex columns are described as having benefits and disadvantages. On page 1385, the authors state, "The question to ask is how do complex columns compare against simple column sequences in terms of utility consumption. The answer is that complex columns are more energy efficient but have larger temperature ranges than simple column sequences. Basically, complex columns are more favorable with respect to first-law effects and less favorable with respect to second-law effects. Thus, if there is an adequate temperature driving force, complex columns will be favored; if not, simple columns are more favorable from a utility point of view." A method is presented in the article for evaluating minimum reflux for complex column, i.e. those with one or more side strippers or enrichers. In the article, the operational definition of a side stripper or enricher is a device that withdraws from a column a side-stream vapor or liquid and returns to the same stage a stream comprising liquid or vapor generated in a second column. Side stripping or enriching necessarily returns to the fractionation column a portion of the withdrawn stream which has been enriched or stripped of its original components.

U.S. Pat. No. 5,435,436 describes a method of ethylene and ethane separation wherein a series of distillation column sections operating at sequentially increasing pressures have communication via certain bottoms liquid and overhead vapor streams. This concept is developed as a "thermo-mechanical" integration and coupling of fractionation stages generally within a stripping section or between two feed stages. Column section pressures increase sequentially wherein the lowest column section (an ethane product section) is operated at a lowest pressure and the highest column section (an ethylene product section) is operated at a highest pressure. Overhead vapor streams of intermediate column sections are compressed to a pressure sufficient to achieve an overall approach to isothermal operation of the entire fractionation system, wherein sensible heat differences in the fractionation column sections and stages are minimized. Liquid bottom streams are flashed to obtain indirect refrigeration of the overhead vapor stream of the highest column section. There is a teaching that the efficiency of separation of ethylene from ethane may be improved when column internal reflux ratio is minimized through the patent's sophisticated design approach. It is also taught that practice of the patent concept for ethylene and ethane creates a dramatic increase in the relative volatilities of those components over the prior art, isobaric column, thereby obtaining the advantages of the high pressure and low pressure C2 splitter in a single system.

U.S. Pat. No. 1,735,558 describes a dual column crude oil fractionationer, wherein three vapor sidedraws from a first column are fed to a second column, whose bottom liquid product stream is returned to a first column stage below the vapor sidedraws.

U.S. Pat. 2,277,387 describes a deethanizer for stabilizing gasoline, wherein an ever increasing pressure gradient is established from the bottom stage of the fractionation device to its top stage. It was pointed out that other columns separate components due to differences in temperature from stage to stage, where in this patent, equilibrium conditions change based on change in pressure.

U.S. Pat. No. 2,327,643 describes a two column method for separating close boiling components. A first column is used to generate a bottoms stream which is split, wherein part of the bottoms stream is further separated in the second column. Condensed overhead from the second column and the second part of the bottoms product of the first column are combined and flashed to provide a heat sink stream for condensing the overhead vapor stream from the first column. The resulting vapor stream is compressed and fed to the bottom of the first column to partially provide reboiling for that column.

U.S. Pat. No. 2,487,147 describes a two column separation of methane and ethane from condensate. Part of the condensed overhead of a second column fractionating the bottoms product of a first column is used to "load up" the first column so as to maintain column pressure. The column pressure is very high.

U.S. Pat. No. 2,666,019 describes a two column separation of methane and ethane from heavier hydrocarbons. A high pressure stripper is partly reboiled directly with compressed overhead vapor from a lower pressure column being refluxed with the bottoms of the high pressure stripper. The high pressure stripper also is reboiled by indirect heat exchange with feed to the process, the feed preferably being effluent from a catalytic reformer. The lower pressure column also receives reflux from its own condensed overhead.

U.S. Pat. No. 4,251,249 describes a single column, split feed deethanizer. The feed to the column is separated by cooling, heating and compression before feeding to the column.

U.S. Pat. No. 4,277,268 describes a two pressure depropanizer. A rectification section is maintained at substantially higher pressure than the stripping section. The column pressures are limited to those for which the temperature and heat load of rectification section overhead vapor stream condensation may be matched entirely with the temperatures and heat load of the reboiling required in the stripping section.

U.S. Pat. No. 4,285,708 describes a two column deethanization of methane and ethane from heavier components. The process feed is split into two portions. A first portion is partly condensed and fed to a stripper whose bottom product is gasoline range material. The overhead from the stripper is fed to a deethanizer along with the other portion of the process feed. Having performed stripping outside of the deethanizer, it is described that cold utilities are reduced for the deethanization.

U.S. Pat. No. 4,705,549 describes a two column deethanizer wherein a condensed portion of the feed stream is fractionated in a higher pressure column. The condensed portion of the overhead vapor of that higher pressure column is stripped in a lower pressure column with the expanded vapor portion of the system feed. An auto-refrigeration effect occurs in the lower pressure column upon stripping of the lighter components.

U.S. Pat. No. 5,152,148 describes using the entire depropanizer bottoms stream to reflux a deethanizer in conjunction with a partially condensed vapor overhead stream from the deethanizer. Only air cooling is used for condensing vapor streams. Propane recovery depends primarily on absorption of propane into the propane-lean bottom stream of the depropanizer.

SUMMARY OF THE INVENTION

The present invention is a set of improvements in deethanizing and depropanizing fractionation steps in NGL processing. The several embodiments of the present invention apply component distribution to multiple columns, interreboiling, intercondensing, thermal coupling and "thermo-mechanicar" coupling to the commonly practiced deethanizer/depropanizer fractionation sequence of NGL processing.

When fractionally distilling a liquid to produce two products of different composition the thermodynamic driving force is the latent heat of vaporization which cascades down in temperature from the reboiler to the condenser. However, the associated sensible heat necessary to cool the feed to the condenser temperature and heat the feed to the reboiler temperature is not used for separation and may be recovered through the use of intercondensers and interreboilers. This heat effect is particularly significant when the feed contains significant amounts of non-key components such as butanes and gasoline in the feed to a conventional NGL deethanizer distillation column.

Although an understanding of the above concept is helpful in identifying areas in which thermodynamic efficiency can be improved in a set fractionation stages, another, potentially more potent concept has been developed by the present inventor for identifying those areas of improvement in thermodynamic efficiency. As described below, the present inventor's novel method of identifying fractionation stages in which inefficient "remixing" is occurring enables the present inventor to inventively apply the concepts of component distribution to multiple columns, interreboiling, intercondensing, thermal coupling and "thermo-mechanical" coupling to overcome the "remixing" inefficiency, as well as other inefficiencies of fractionation.

Thermal coupling and "thermo-mechanical" coupling are concepts only partially developed in the prior art. The present invention makes novel applications of the concepts for retrieving from NGL an ethane product, a propane product and a stream of components heavier than isobutane. More particularly, the objects of the present invention are most advantageous when at depropanization and at least a portion of the deethanization stages are operated at low pressure. Herein, the phrase "low pressure" refers generally to the pressure range from about 100 psia to 350 psia, more preferably between from about 200 psia to about 300 psia.

BRIEF DESCRIPTION OF THE DRAWINGS

FIGS. 1B and 2B are graphical plots of the mole percents of several NGL components, selected from the group comprising ethane, propane, isobutane, normal butane and others, according to the fractionation evaluated, versus the stage temperature of a column. A legend of the components is shown on the Figures, correlating the component with a lower case letter. A theoretical stage in the column is represented by each use of a lower case letter printed on the plot, thereby indicating the stage temperature and the mole percent of the component on that stage. Each of the temperature/composition plots in FIGS. 1B and 2B represent at least a portion of the fractionation sequence shown in FIGS. 1A and 2A, respectively.

FIGS. 1C and 2C are McCabe-Thiele diagrams for the depropanizer of FIGS. 1A and 2A.

DETAILED DESCRIPTION OF THE INVENTION

The technology disclosed below improves the thermodynamic efficiency for processing natural gas liquids with consequent reductions in operating and investment costs. Each technological improvement is discussed first in isolation to identify its specific processing advantage; but, it is the combined and interrelated effects of the several improvements, which produce the most economical process.

EXAMPLE 1

Prior Art Deethanizer/Depropanizer

The critical temperature for ethane is about 90° F., so NGL deethanizer distillation columns require refrigerated condensers when producing relatively pure ethane. Even when producing ethane/propane mixtures refrigeration is often used to condense the overhead product. In order to minimize refrigeration costs deethanizers are designed and operated for relatively high pressures of about 450 psia. The resulting condenser temperatures of about 56° F. (for relatively pure ethane) are also high enough to preclude the formation of hydrates which can plug equipment. However, the high pressures necessitate thick walled vessels with relatively large diameters. The large diameters are a consequence of the small differences in vapor and liquid composition, density, and enthalpy which develop as the pressure approaches the mixture critical point and which affect the K-values, phase separation, and thermal driving force in the column. Deethanizers are designed to optimize the economic balance of capital and operating costs under the above considerations.

Deethanized NGL is usually fed to a depropanizer distillation column which is designed and operated for about 250 psia because commercial propane can be condensed with cooling water at this pressure. The design of the depropanizer is economically optimized independently of the deethanizer although the two columns may be heat integrated with bottoms product coolers.

Figure 1A:
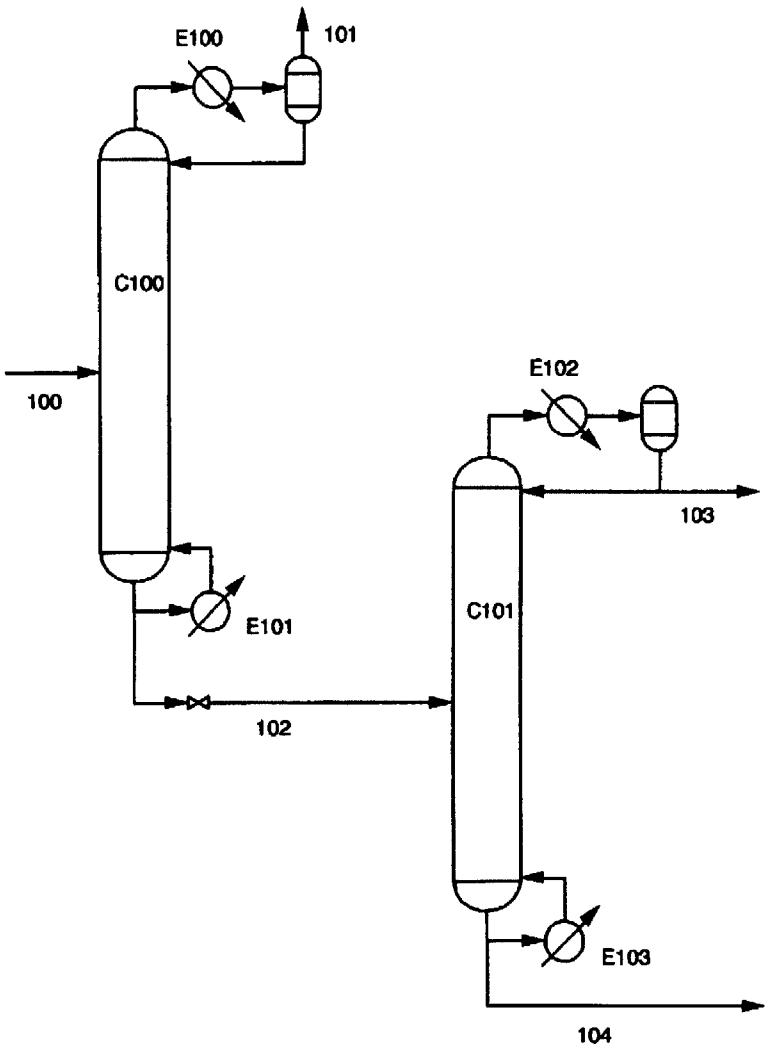
FIG. 1A is a generalized prior art deethanizer/depropanizer fractionation sequence.

FIG. 1A shows a typical NGL deethanizer/depropanizer distillation system which is fed with a NGL mix containing butanes and gasoline in addition to the ethane and propane. Table 1 gives compositions and conditions for the following streams:

| Stream No. | Stream Description |
|---|---|
| 100 | NGL deethanizer feed with butanes/gasoline, at bubble point |
| 101 | overhead vapor product from deethanizer, column C100 |
| 102 | bottoms liquid product from deethanizer, column C100 |
| 103 | overhead liquid product from depropanizer, column C101 |
| 104 | bottoms liquid product from depropanizer, column C101 |

In FIG. 1A, the deethanizer, column C100 with about 18 theoretical stages and a feed stage at about 8 stages from the top stage, produces an overhead vapor stream which is partially condensed in a condenser, exchanger E100, to provide reflux to column C100. The depropanizer, column C101 with about 34 theoretical stages and a feed stage at about 13 stages from the top stream, produces an overhead vapor stream which is fully condensed in a condenser, exchanger E102. Table 1 provides duties for the exchangers shown in FIG. 1A.

For 100 MBPD of a typical feed composition separated by fractionation in columns C100 and C101, 98.9 MMBtu/Hr at exchanger E101 (column C100 reboiler) and 89.7 MMBtu/Hr at exchanger E103 (column C101 reboiler), totaling 188.6 MMBtu/Hr, are required to achieve product specifications for streams 101 and 103. For purposes of all embodiments described herein, Table 7, entitled "Typical Specifications for NGL Fractionation", will serve as a reference for product specifications referred to herein. Such specifications are not limitations of the present invention, but serve as a basis of comparison for operation of the present invention with the prior art. Using a common method for calculation of diameters of fractionation columns using sieve trays (which method will be used consistently herein for calculation of column diameters), the diameters of the column C100 rectifying and stripping sections are about 12 feet and 19.5 feet respectively. The calculated diameter of both the rectifying and stripping sections of column C101 is about 13 feet.

Figure 1B:
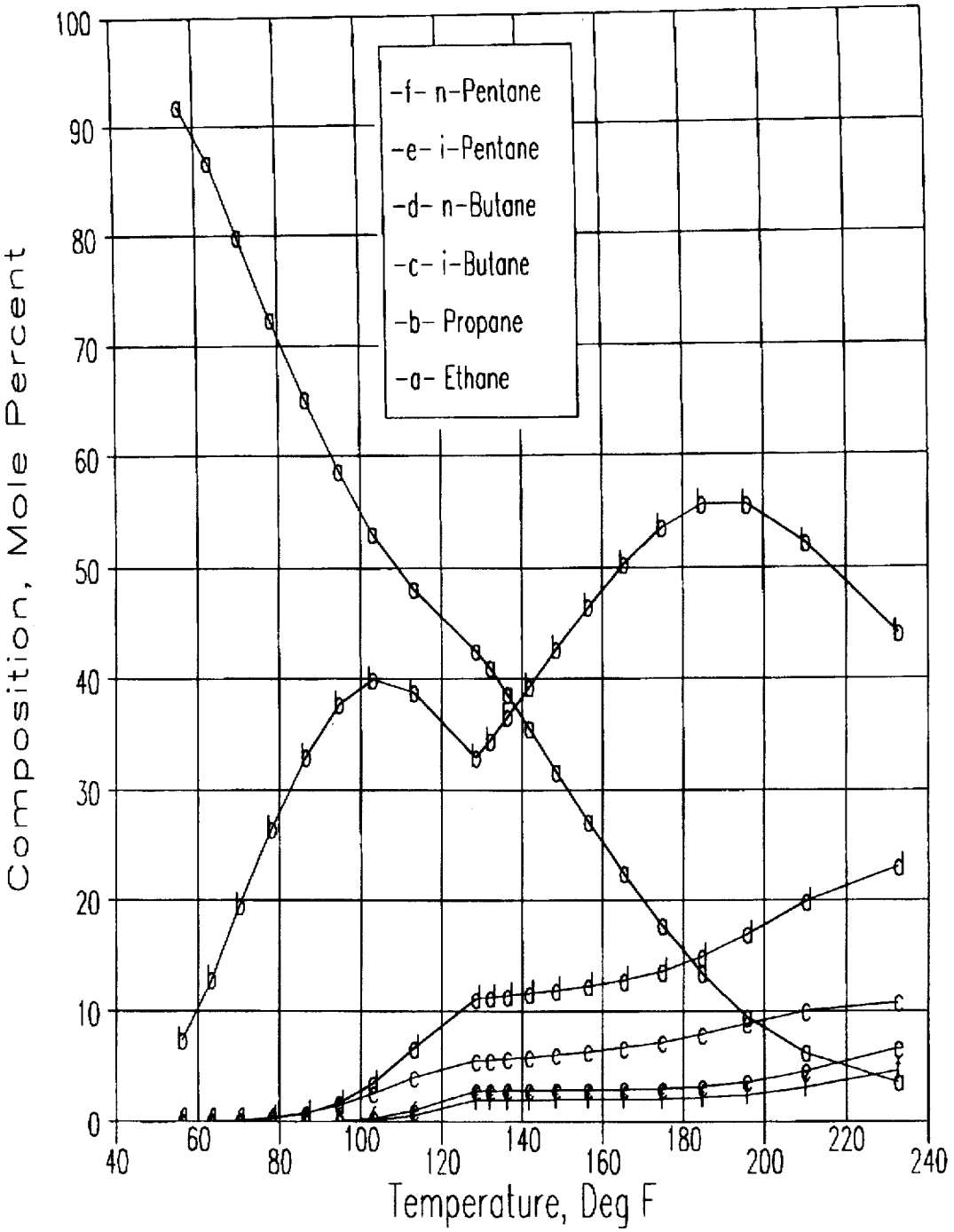

FIG. 1B shows the temperature/composition profile for the deethanizer column C100 in FIG. 1A. A careful examination of such diagrams has led the present inventor to discover a condition which has been largely unappreciated by others. Ethane and propane are effectively separated in most of the column at temperatures below about 200° F. However, at temperatures above about 200° F. in the bottom of column C100 and in the reboiler, exchanger E101, the ratio of ethane to propane changes very little while the ratio of butanes to propane almost doubles. This "remixing" of the heavy key component and the heavier non-key components increases the separation work required in the downstream depropanizer. The "remixing" effect is shown graphically in FIG. 1B by plotting of relative amounts of components in NGL fractionation. If lighter than light key or heavier than heavy key components are to be separated from the light key or heavy key components respectively in downstream fractionation zones, then the remixing near the top and/or bottom of a first fractionation zone must be reversed and the separation repeated in the downstream fractionation zones. This repeated, additional separation in the downstream fractionation zones is, as compared with the examples below wherein remixing is minimized or eliminated, often a significant cost in terms of utilities and equipment.

Figure 1C:
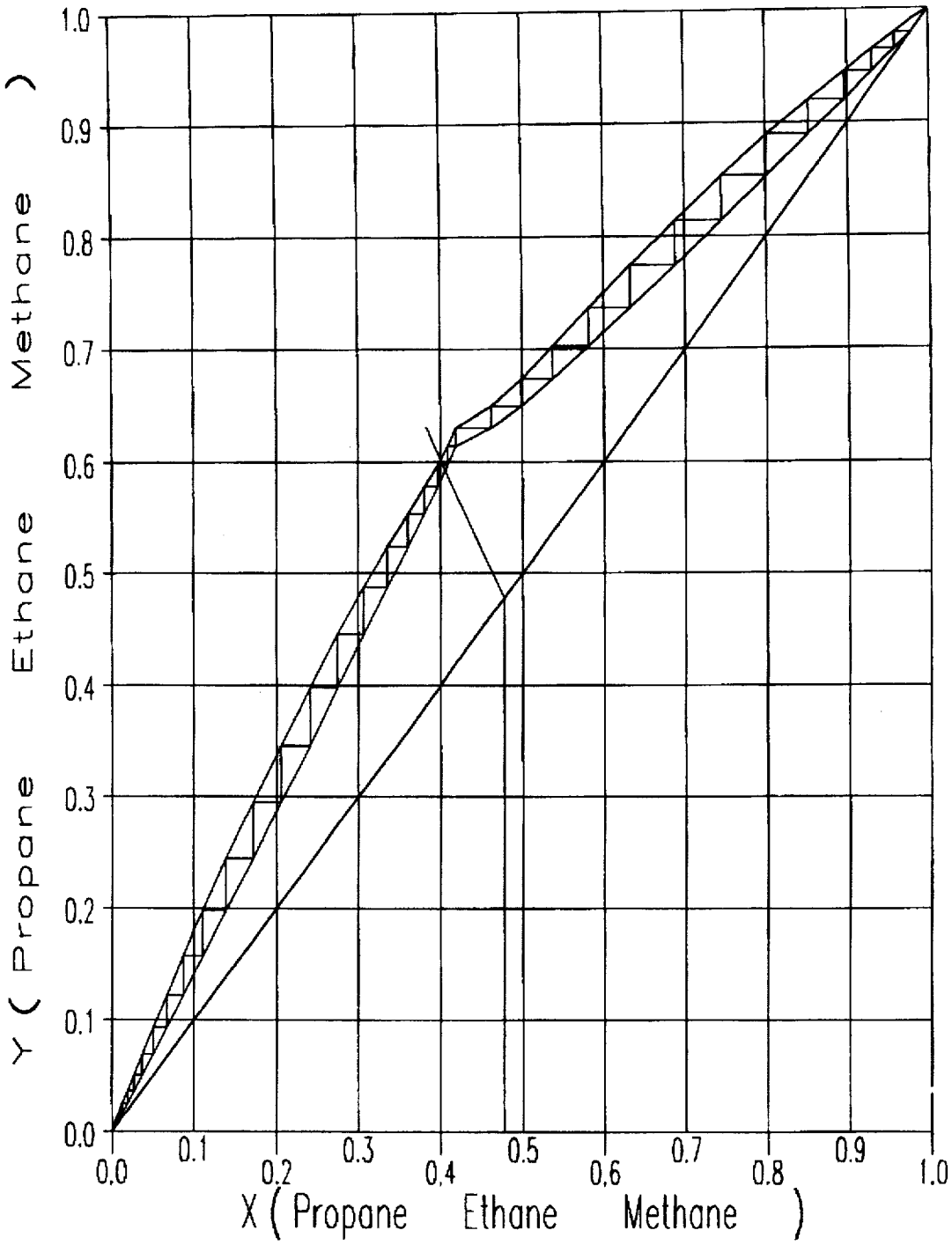

FIG. 1C shows a McCabe-Thiele diagram for the column C101 depropanizer for which the feed contains about 45 mole percent propane.

EXAMPLE 2

Thermally Coupled Low Pressure Deethanizer and Depropanizer

It has been discovered that the inefficient "remixing" of propane and butanes in the bottom of the deethanizer can be eliminated by reducing the deethanizer pressure to match the depropanizer and by thermally coupling the two columns. Thermal coupling, as used herein, shall refer to the diversion of at least part of a vapor or liquid stream from a downstream fractionation zone to an upstream fractionation zone, wherein the downstream fractionation zone has also directly received a liquid or vapor stream from the upstream fractionation zone.

It is known that a relatively low pressure (about 250 psia) deethanizer requires more refrigeration utilities but has a much smaller diameter and requires less reboiler duty than the relatively high pressure (about 450 psia) deethanizer. However, for this example and embodiment, a specific method of thermal coupling a low pressure deethanizer with a depropanizer results in a surprising reduction in overall equipment size (and thus capital cost). In addition, reboiler duty for depropanizing is also reduced. The combined system then provides optimum economics.

Figure 2A:
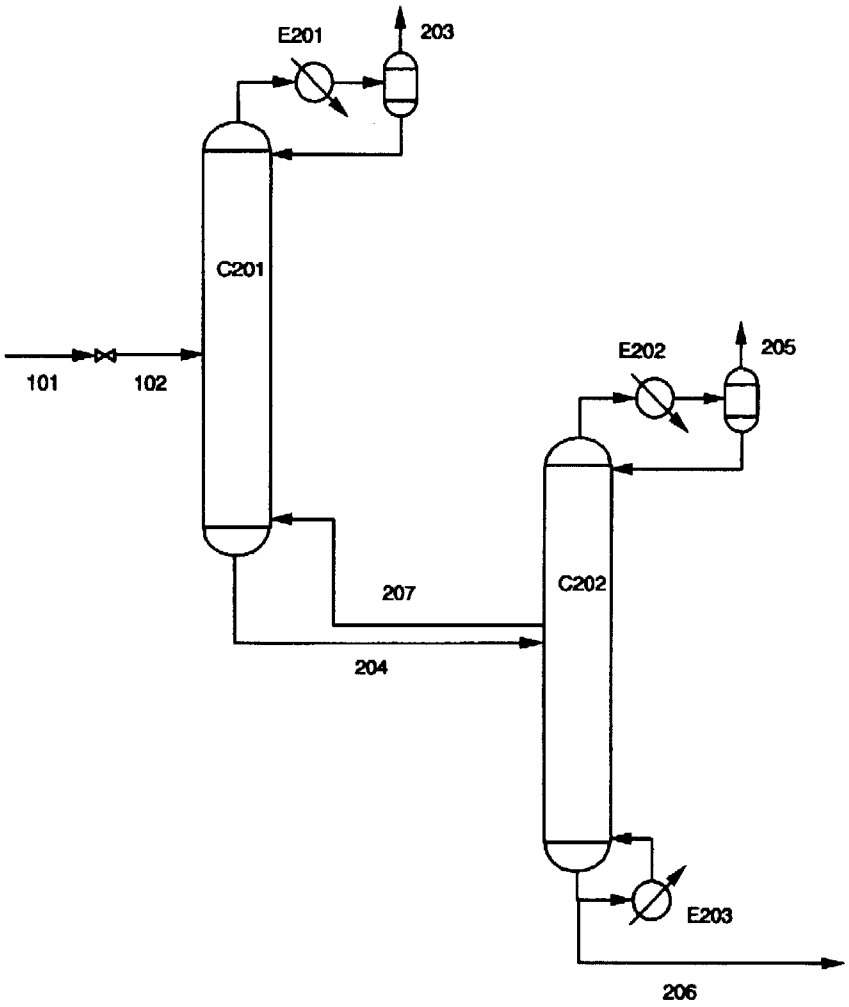
FIG. 2A is an embodiment of the present invention, a thermally coupled deethanizer/depropanizer fractionation sequence.

FIG. 2A shows the thermally coupled low pressure deethanizer and depropanizer of the present invention. Table 2 gives compositions and conditions for the following streams:

| Stream No. | Stream Description |
|---|---|
| 200 | NGL deethanizer feed with butanes/gasoline, at bubble point |
| 201 | overhead vapor product from deethanizer, column C200 |
| 202 | bottoms liquid product from deethanizer, column C200 |
| 203 | overhead liquid product from depropanizer, column C201 |
| 204 | bottoms liquid product from depropanizer, column C201 |
| 205 | thermal coupling vapor sidedraw from column C201 to the bottom of column C200 |

In FIG. 2A, the deethanizer, column C200, produces an overhead vapor stream which is partially condensed in a condenser, exchanger E200, to provide reflux to column C200. The depropanizer, column C201, produces an overhead vapor stream which is fully condensed in a condenser, exchanger E202. Table 2 provides duties for the exchangers shown in FIG. 2A.

For 100 MBPD of a typical feed composition, stream 200, separated by fractionation in columns C200 and C201, a reboiler is eliminated for column C200 over the prior art design shown in FIG. 1 and exchanger E203 (column C201 reboiler), uses 144.7 MMBtu/Hr of hot utility to supply reboiling duty to columns C200 and C201.

A net reduction of 43.9 MMBtu/Hr in hot utilities over the conventional case described for FIG. 1 is due in large part to the lower vapor and liquid flow rates in columns C200 and C201 as well as to lowering the condensing temperature overhead vapor stream of the deethanizer, column C200. It is due to his novel method of remixing analysis that the present inventor can discern the potential for utilities savings from thermodynamic improvement. Without such remixing analysis, the skilled person must necessarily adopt a trial and error approach to recognizing similar improvements in thermodynamic efficiency. Over half of the reduction in hot utilities for this example compared the first example is due to the reduced separation work required in the depropanizer, column C201, as a result of the elimination of "remixing" of butanes and propane in the deethanizer. An additional proof that remixing analysis and application (i.e., identifying the sections in a fractionation process where remixing could be advantageously reduced) is highly productive of obtaining thermodynamic efficiency is that 33.9 MMBtu/Hr is eliminated from the required cold utilities for the depropanizer condenser, exchanger E202, compared to the cold utilities required for the depropanizer of example 1.

FIG. 2B shows the temperature/composition profile for the low pressure thermally coupled deethanizer, column 200, in FIG. 2A. The temperatures over the deethanizer, column C200, fractionation stages are lower than in those of the comparable fractionation stages of the conventional case of example 1 because (1) the lower pressure, (2) the "remixing" of butanes and propane has been eliminated, and (3) the depropanizer feed, stream 202, contains about 65 mole percent propane. This increase in propane concentration in stream 202 reduces necessary condenser and reboiler duties for depropanizing in column C201. FIG. 2C shows a McCabe-Thiele diagram for the thermally coupled depropanizer, column C201, with rectifying section diameter of about 10 feet, a reduction of about 40 percent in cross sectional area over that of the depropanizer of example 1. The column C200 rectifying and stripping sections obtain diameter reductions to about 10 feet and 13.5 feet, respectively. In addition, the wall thickness, weight, and cost of the deethanizer will be further reduced because of the lower operating pressure.

The thermally coupled depropanizer, column C201, stripping section is increased in diameter to about 19.5 feet as a result of passing through the column C201 stripping section the reboiling flows for two columns, C200 and C201. The relatively wide separation of the operating and equilibrium lines in the stripping section for McCabe-Thiele diagram of FIG. 2C indicates an opportunity to improve thermodynamic efficiency by use of an interreboiler in the stripping section of column C201, the depropanizer. Column C201 stripping section diameter will be significantly reduced with an interreboiler positioned between about 10–14 stages from the bottom of column C201. In addition, considerable reboiler duty for column C201 is moved to a lower temperature level. Similarly, an interreboiler in column C200, the deethanizer, will further reduce the diameter of its stripping section and move more high temperature utility duty, i.e., the reboiling duty for column C200, to an even lower temperature.

The above reductions in size and utility consumption are offset by the increased refrigeration and drying requirements for the deethanizer condenser, exchanger E200, which now operates at about 15° F. However, the overall economics, i.e., the comparative savings for both equipment and utilities, favor the low pressure thermally coupled deethanizer and depropanizer of this example 2.

The low pressure deethanizer and thermally coupled depropanizer can be considered as one tall column containing the deethanizer and depropanizer stripping section with the depropanizer rectifying section as a side rectifier.

EXAMPLE 3

Deethanizer/Depropanizer Sequence (Ethane/Propane Mixture Product)

Deethanized NGL is usually fed to a depropanizer designed and operated for about 250 psia because commercial propane can be condensed with cooling water at this pressure.

To minimize energy consumption the depropanizer bottom liquid product can be subcooled while interreboiling the deethanizer column. In addition to reducing the deethanizer reboiler duty this heat integration also reduces the diameter of the deethanizer below the interreboiler.

Figure 3A:
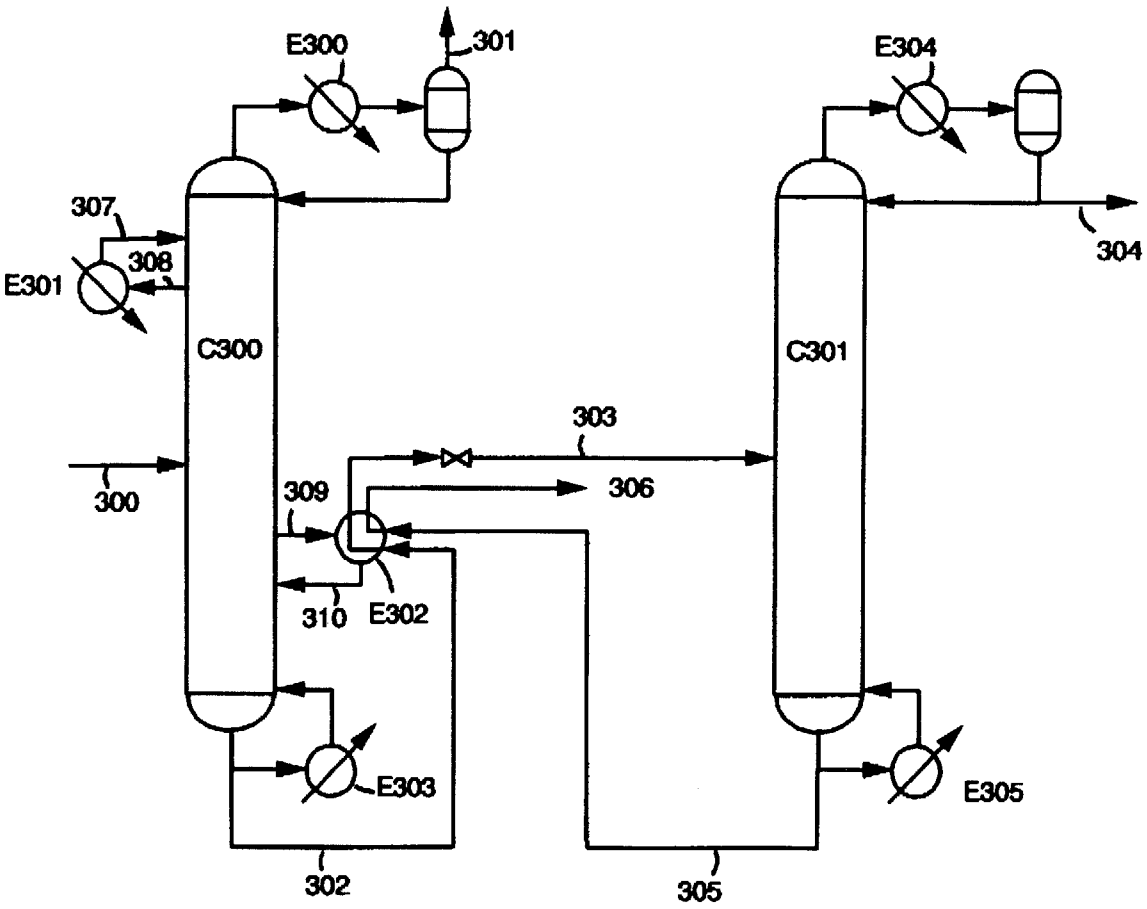
FIG. 3A shows a deethanizer/depropanizer fractionation sequence. Heat is recovered from bottoms product streams of both the deethanizer and depropanizer. The heat is transferred to a single interreboiler for the deethanizer.

FIG. 3A shows an NGL deethanizer/depropanizer fractionation sequence which is fed with a NGL feed containing butanes and gasoline in addition to the ethane and propane. An ethane/propane mix of about 78 volume percent ethane is produced from as the overhead vapor product of the deethanizer. The ethane/propane mixture product, the propane product and the butanes and gasoline stream are cooled and pumped to battery limits conditions. Targeted (energy balanced, but not heat integrated) steam, cooling water, and propane refrigeration utility processes are included in order to estimate the total energy requirements.

Table 3 gives compositions and conditions for the following streams:

| Stream No. | Stream Description |
|---|---|
| 300 | NGL deethanizer feed with butanes/gasoline |
| 301 | overhead vapor product (ethane/propane) from deethanizer, column C300 |
| 302 | bottoms liquid product from deethanizer, column C300 |

-continued

| Stream No. | Stream Description |
|---|---|
| 303 | subcooled bottoms liquid product from column C300, feed to column C301 |
| 304 | overhead liquid product from column C301 |
| 305 | bottoms liquid product from column C301 |
| 306 | subcooled bottom liquid product from column C301 |
| 307 | partially condensed vapor sidedraw from stage 4/column C300 |
| 308 | vapor sidedraw from stage 4/column C300 |
| 309 | liquid sidedraw from stage 21/column C300 |
| 310 | partially vaporized liquid sidedraw to stage 21/column C300 |

In FIG. 3A, the deethanizer, column C300, produces an overhead vapor stream which is partially condensed in a condenser, exchanger E300, to provide reflux to column C300. The depropanizer, column C301, produces an overhead vapor stream which is fully condensed in a condenser, exchanger E304. Table 3 provides duties for the exchangers shown in FIG. 3A. The other exchangers are exchangers E301 (an intercondenser for column E300), E302 (an interreboiler for column C300), E303 (reboiler for column C300), and E305 (reboiler for column C301). Column C300 comprises about 29 theoretical stages, with stream 300 fed to column C300 at about 12 stages from the top of stage of column C300. Column C300 operates at about 450 psia. For the purpose of evaluating fractionation stages in a named column in all the descriptions below, stages shall be numbered from the top to bottom stages and the top most stage shall be stage number "1".

Exchanger E301 partially intercondenses stream 308 from stage 4/column C300 and returns stream 307 to stage 4 of column C300. Exchanger E302 partially vaporizes stream 309 from stage 20/column C300 and returns stream 310 to stage 20/column C300. Streams 302 and 305 are cooled in exchanger E302 to recover reboiling heat from a higher temperature level to a lower temperature level. Stream 303, having been first subcooled in exchanger E302, is then flashed and fed to column C301 at about stage 12. Column C301 is about 30 stages and operates at about 250 psia. It will be understood hereafter that reference herein to intercondensing hereafter refers in general to the operation described above for withdrawal of a sidedraw vapor to a heat exchanger where it is at least partially condensed and the return to a column stage of the partially condensed stream. It will further be understood that reference herein interreboiling and partial interreboiling refers in general to the withdrawal of a sidedraw liquid to a heat exchanger where it is at least partly vaporized, and return of the partially vaporized stream to a column stage, as described in this example 3 and example 4, below.

Figure 3B:
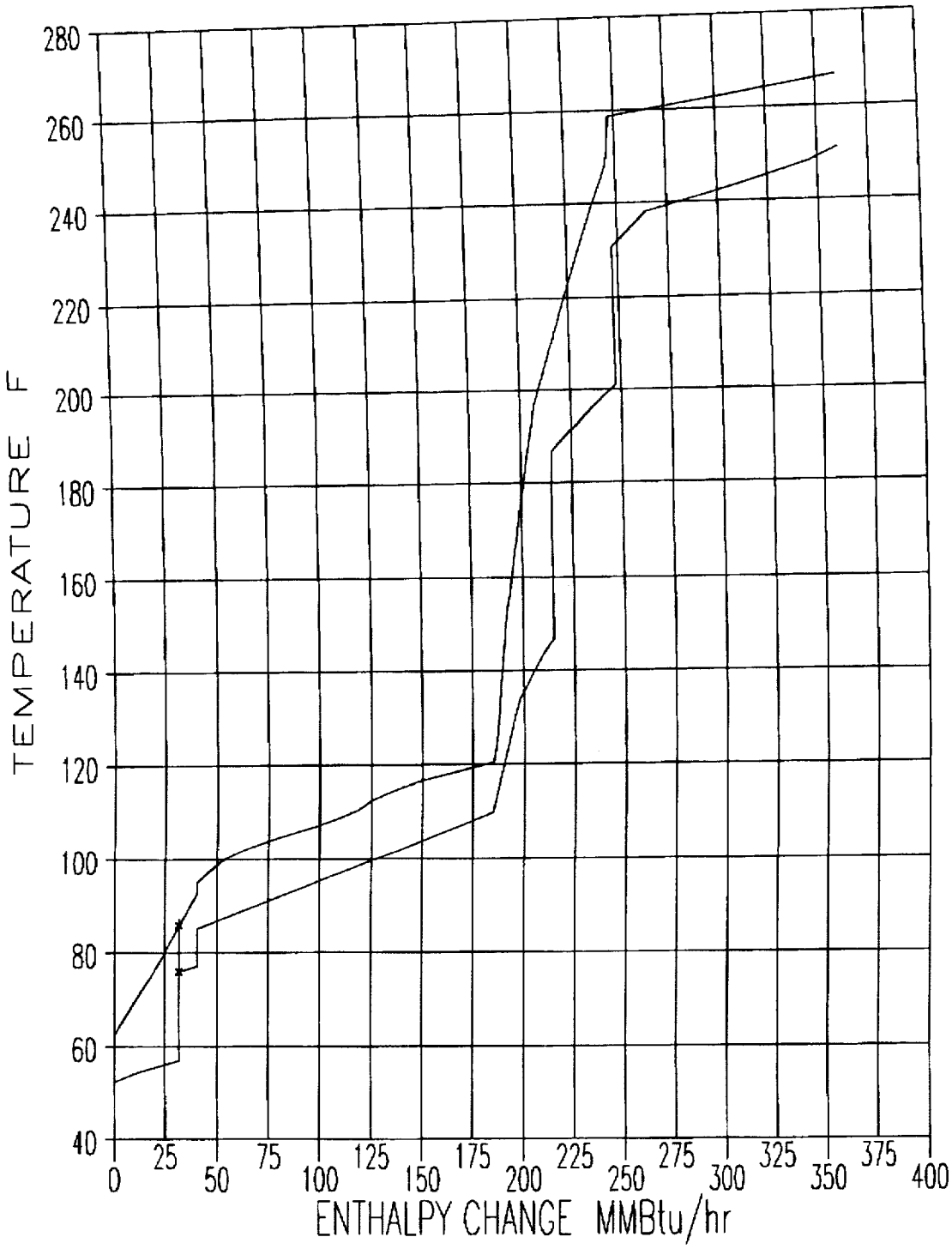
FIGS. 3B, 4B, 5B, and 6B shows the composite heating and cooling curves for the process and utilities used to effect the deethanization and depropanization shown in FIGS. 3A, 4A, 5A and 6A respectively.

FIG. 3B shows the composite heating and cooling curves for the process and utilities in the system used to effect the deethanization and depropanization shown in FIG. 3A. The definition of the system is the equipment shown on FIG. 3A, as well as associated equipment and utilities necessary for production of utilities for the equipment shown in FIG. 3A (not shown). It is well understood by the skilled person that refrigeration and heating utilities are obtained by operation of commonly available and well defined equipment. Because the decision to implement significant process changes depends on the overall impact of utilities, a broader summation of energy requirements is most helpful in evaluating the embodiments of the present invention.

The following conclusions are obtainable from the composite heating and cooling curve of FIG. 3B. For production of streams 301,304 and 306 from 100M BPD of feed, stream 300, in the present example, a total of 361.4 MMBtu/Hr are transferred within the system, 122.6 Mlbs of high pressure steam are required and 9.0 MMBtu/Hr of excess turbine power are generated. The excess power results from an imbalance in the high and low pressure steam requirements because of the relatively low reboiler temperatures of about 250° F. It is assumed that the process is isolated so that only high pressure (450 psig and 600° F.) steam is available, and it is expanded to low pressure through power generating turbines. The deethanizer, column C300, is calculated to have rectifying and stripping section diameters of about 10.5 feet and 14 feet respectively. The depropanizer, column C301, is calculated to have a single diameter of about 13 feet.

Figure 3C:
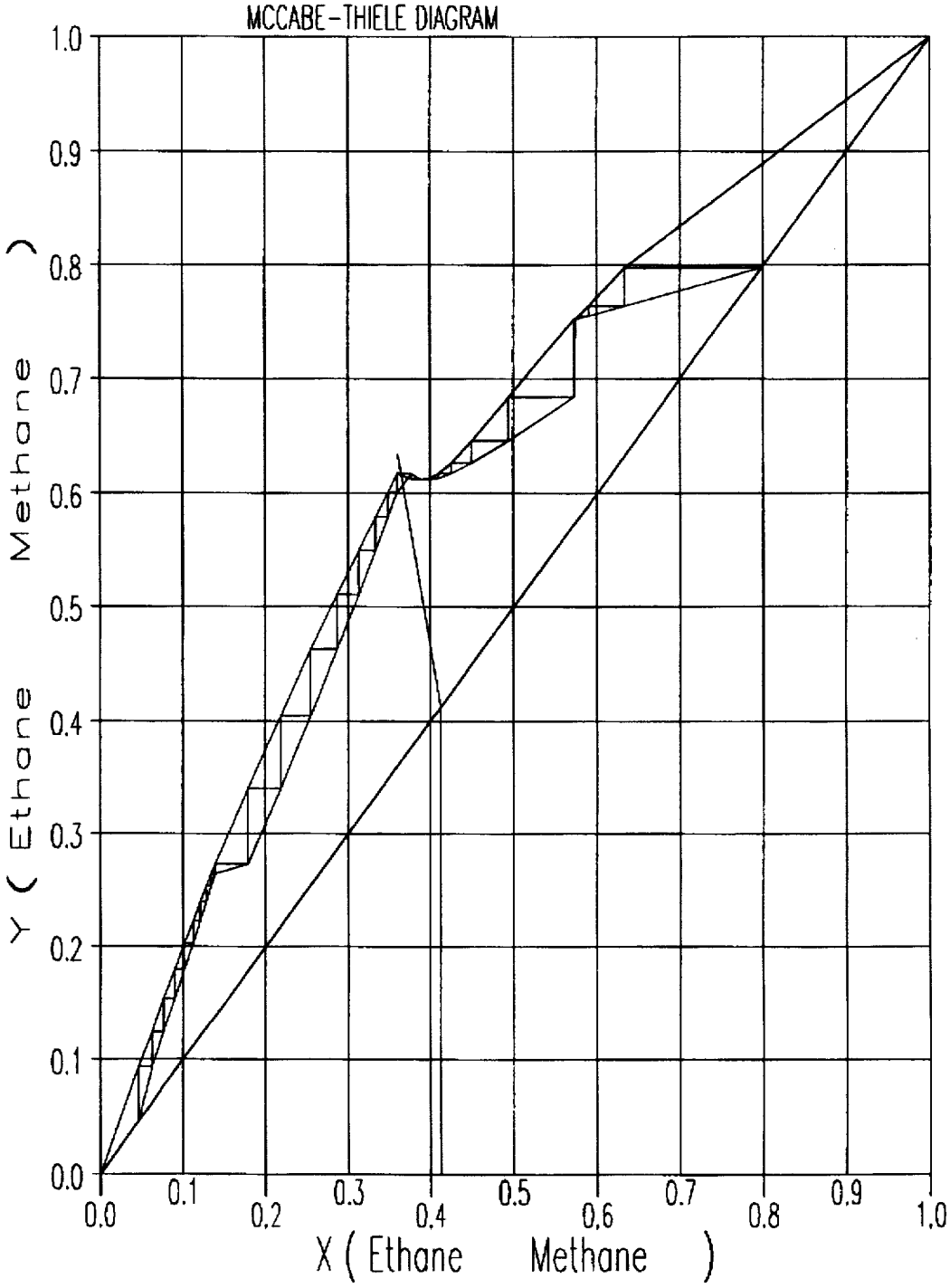
FIGS. 3C, 4C and 5C show McCabe-Thiele diagrams for the deethanization stages represented in the equipment shown in FIGS. 3A, 4A, and 5A, respectively.

FIG. 3C shows a McCabe-Thiele diagram for the deethanizer, column C300, which includes an intercondenser, exchanger E301, and an interreboiler, exchanger E302. The feed to the deethanizer, stream 300, is preheated to saturation.

Figure 3D:
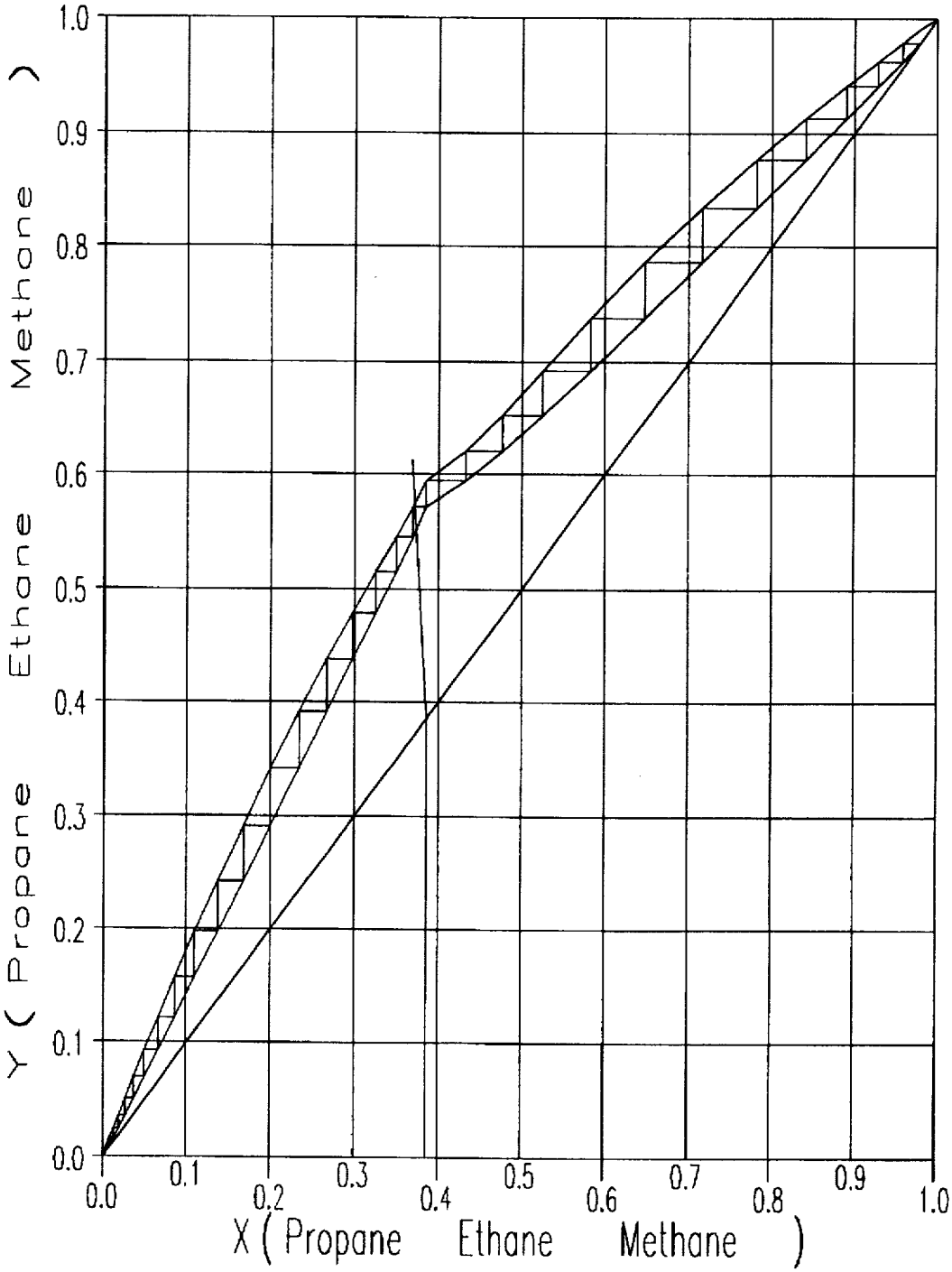
FIGS. 3D, 4D and 5D show McCabe-Thiele diagrams for the depropanization stages represented in the equipment shown in FIGS. 3A, 4A, and 5A, respectively.

FIG. 3D shows a McCabe-Thiele diagram for the depropanizer, column C301.

EXAMPLE 4

Thermomechanically Integrated Deethanizer (EP Mix)

As discussed above the relatively high pressure (about 450 psig) of a deethanizer requires a large and expensive distillation column. A lower pressure deethanizer would be economically advantageous, as described in example 2, if it were thermally coupled with the downstream depropanizer. The higher cost of the lower temperature (higher utilities per unit of condensed reflux) refrigeration system for a low pressure deethanizer will be significantly offset by elimination of drying the deethanizer feed.

Unfortunately, without drying the feed, fouling hydrates will form in the condensers of prior art low pressure deethanizers. The present invention in this example's embodiment has eliminated the risk of hydrate formation on the heat transfer surfaces of the condensers needed for low pressure deethanization.

Figure 4A:
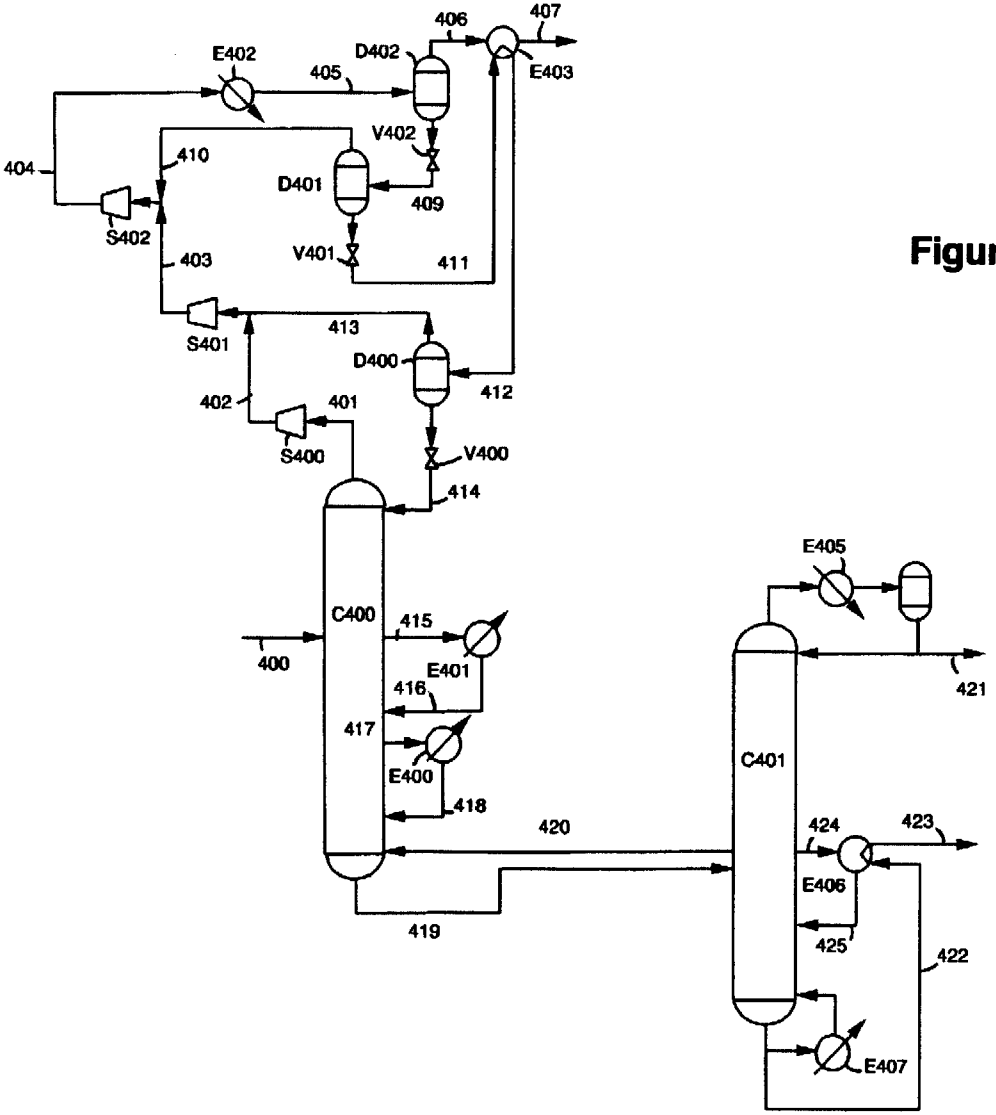
FIG. 4A shows an improvement to the fractionation sequence of FIG. 3A. The top most rectification stages of the deethanizer are integrated and coupled by application of "thermo-mechanical" concepts. A depropanizer fractionates the deethanizer bottom product. A vapor sidedraw from the depropanizer is fed to the bottom of the deethanizer to supply reboiling. Interreboilers are applied to both the deethanizer and the depropanizer.

This example of present invention uses multi-pressure deethanization stages for column vapor intercompressing, as shown in FIG. 4A. The surprising advantage achieved, in addition to eliminating the drying for low pressure deethanization, has been that the refrigeration compressor is also eliminated. This is a "thermomechanical" integration as described above. The overhead vapor stream, passing from a deethanizer column to the "thermomechanical" compression stages comprising the top most deethanization stages, contains from 30 to 50 volume percent propane. Upon compression and condensation with cooling water, that propane-containing stream makes an efficient refrigeration fluid for condensation of the ethane/propane vapor product stream. When an ethane product is desired, as described for example 6, instead of an ethane/propane product, the propane-containing stream is most efficiently used as a refrigeration stream for an intercondenser, as described in a later example.

The compression, condensation and separation of the process streams in the top most deethanization stages for this example thus displaces the refrigeration condenser of the prior art low pressure deethanizer. As described in example 3, for a heat integrated high pressure deethanizer and low pressure depropanizer, excess turbine power (from the high pressure steam) is available. Excess turbine power is also similarly available in the present example for supplying the comparatively higher compression power required for thermomechanical integration of the present example.

As a result of the elimination of the refrigeration compression needed for a prior art low pressure deethanizer, a larger, and not additional, compressor must be purchased for operation of a deethanization of the present example. Much of the refrigeration system is now eliminated since it dually functions as part of the deethanizer rectifying section.

FIG. 4A shows a low pressure thermomechanically integrated deethanizer with a thermally coupled depropanizer for producing ethane/propane mixtures (78 volume % ethane) from an NGL mixture feed containing butanes and gasoline in addition to the ethane and propane. The process products are cooled and pumped to battery limits conditions. Targeted (energy balanced, but not heat integrated) steam and cooling water utility processes are included in order to estimate the energy requirements. Table 4 gives compositions and conditions for the following streams:

| Stream No. | Stream Description |
|---|---|
| 400 | NGL deethanizer feed with butanes/gasoline |
| 401 | overhead vapor stream from deethanizer, column C400 |
| 402 | compressed vapor stream from stage S400 |
| 403 | compressed vapor stream from stage S401 |
| 404 | compressed vapor stream from stage S402 |
| 405 | partially condensed stream from exchanger E402 |
| 406 | vapor portion of stream 405 |
| 407 | liquid ethane/propane product stream condensed in exchanger E403 |
| 409 | liquid portion of stream 405, flashed at valve V402 |
| 410 | vapor portion of stream 409 |
| 411 | liquid portion of stream 409, flashed at valve V401 |
| 412 | partially vaporized stream 411 from exchanger E403 |
| 413 | vapor portion of stream 412 |
| 414 | liquid portion of stream 412, flashed at valve V400 |
| 415 | liquid sidedraw for interreboiling from stage 17/column C400 |
| 416 | partially vaporized liquid sidedraw return to stage 24/column C400 |
| 417 | liquid sidedraw for interreboiling from stage 24/column C400 |
| 418 | partially vaporized liquid sidedraw return to stage 31/column C400 |
| 419 | bottoms liquid product from column C400 to column C401 |
| 420 | vapor sidedraw from stage 14/column C401 to bottom of column C400 |
| 421 | overhead liquid propane product from column C401 |
| 422 | liquid bottoms product from column C401 |
| 423 | subcooled bottoms liquid product from C401 |
| 424 | liquid sidedraw for interreboiling from stage 15/column C401 |
| 425 | partially vaporized liquid sidedraw return to stage 25/column C401 |

In FIG. 4A, the deethanizer, column C400, comprises about 38 stages, with a feed stage for stream 400 at stage 17. As described above, the partial interreboilers, exchangers E400 and E401, withdraw liquid sidedraws, partially vaporize the liquid streams and return the partially vaporized streams to column C400. The depropanizer, C401, comprises 37 stages, with a feed stage for stream 419 at stage 14. As described above, the partial interreboiler, exchanger E406, withdraws a liquid sidedraw, partially vaporizes the liquid stream and returns the partially vaporized stream to column C400. Column C401 has an associated overhead condenser, exchanger E405, and a reboiler, exchanger E407. Table 4 provides duties for the exchangers shown in FIG. 4A. The other exchangers in FIG. 4A are exchangers E402 (an cooling water condenser for partially condensing vapor from the highest level of compression, stage S402), and E403 (the ethane/propane product condenser refrigerated with flashed, condensed process liquid). Valves V400, V401 and V402 are valves across with pressure is suddenly reduced for liquid streams from their upstream drums.

In the FIG. 4A, the deethanizer, column C400, and the depropanizer, column C401, operate at about 250 psia. Column C400 is at least partly reboiled using a vapor side draw stream, stream 420, from the downstream depropanizer. This thermal coupling reduces the work of separation required in the depropanizer, as described above in example 2.

The stripping sections of columns C400 and C401 are partially interreboiled to improve the process energy efficiency and reduce the column diameters (i.e., see exchangers E400, E401 and E406 in FIG. 4A). For the partial interreboilers, in contrast to the interreboilers of the prior art, withdrawal and return of sidedraws spans a relatively large number of stages. In the present example, exchangers E400, E401 and E406 span 7, 7 and 5 stages, respectively. The present inventor has found that this method of partial interreboiling reduces the temperature of the reboiler feeds so that process heat integration is more easily achieved by making available better approach temperatures for heat transfer. It is preferable to recover as much heat as possible from the bottom liquid products of fractionation columns, as shown for stream 422 where heat is transferred to the partial interreboiler, exchanger E406.

The deethanization stages in FIG. 4A include those of column C400 and also includes the separation that takes place in the compression, condensing and separation steps of the thermomechanical section above column C400. The thermomechanical integration includes a three stage compressor system, stages S400, S401 and S402, to compress the column C400 overhead vapor stream, stream 401, from about 254 psia and 63° F. to about 506 psia and 95° F. Drums D400, D401 and D402 dually function as additional deethanizing rectification stages and refrigeration separation drums. The liquid, stream 411, from an intermediate pressure (420 psia) drum, drum 401, is used as a refrigerant to condense the column overhead product in exchanger E403.

Figure 4B:
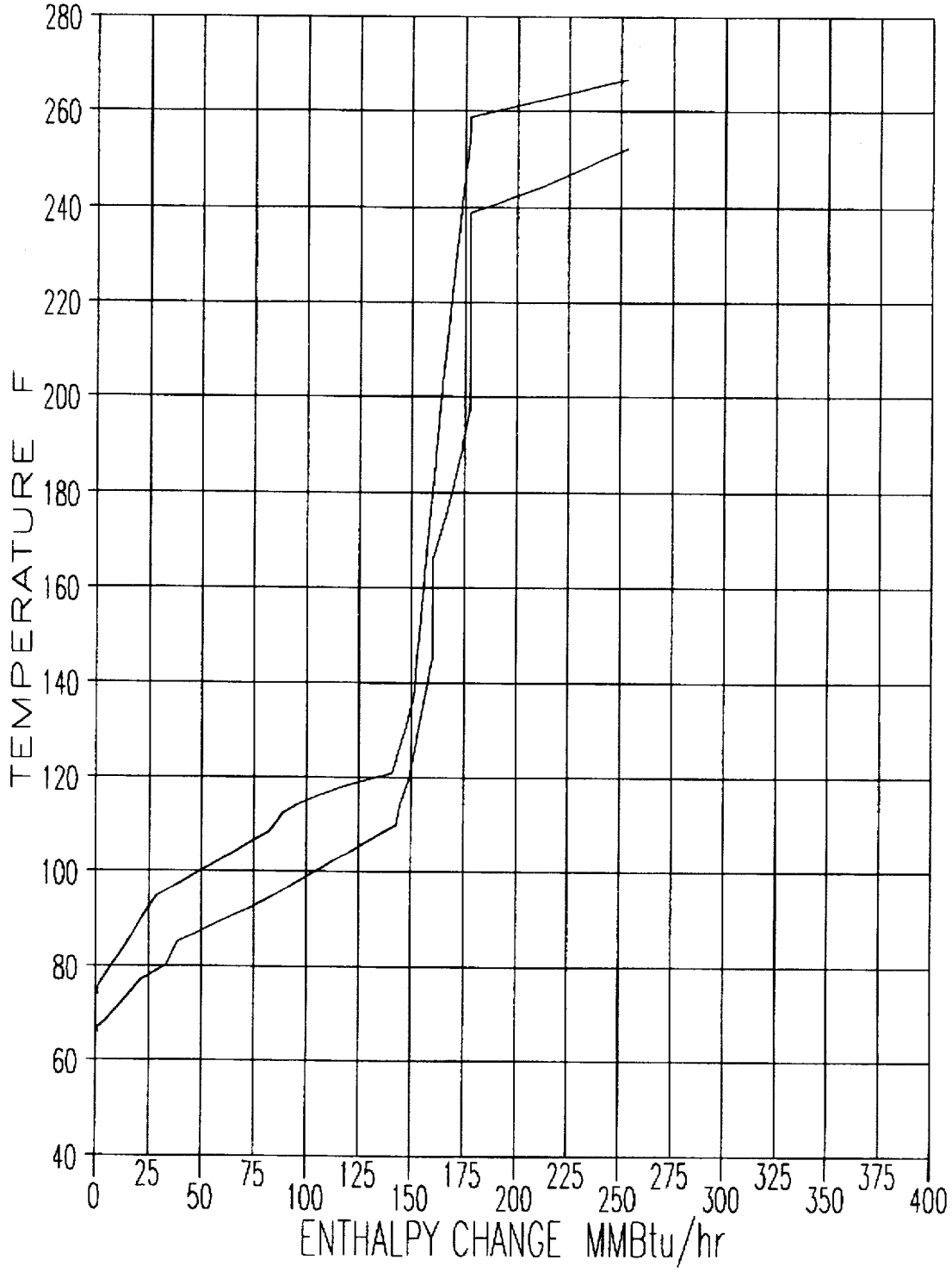

FIG. 4B shows the composite heating and cooling curves for the thermomechanically integrated process and utilities. For 100 MBPD of feed, stream 400, a total of 262.1 MMBtu/Hr are transferred, 82.1 Mlbs of high pressure steam are required, and a deficit of 3.3 MMBtu/Hr of turbine power is consumed. These results are, respectively, 27% and 33% less than heat transferred and steam required over the system represented by FIG. 3A. However, a small amount of power must now be purchased or generated from downstream processing. The diameters of the deethanizer, column C400, rectifying and stripping sections are about 9.5 feet and 10.5 feet, respectively. The diameters of the depropanizer, column C401, rectifying and stripping section diameters are about 10 feet and 13 feet respectively. Except for the depropanizer stripping section these are significant reductions over the column diameters required in the process represented by FIG. 4A.

Figure 4C:
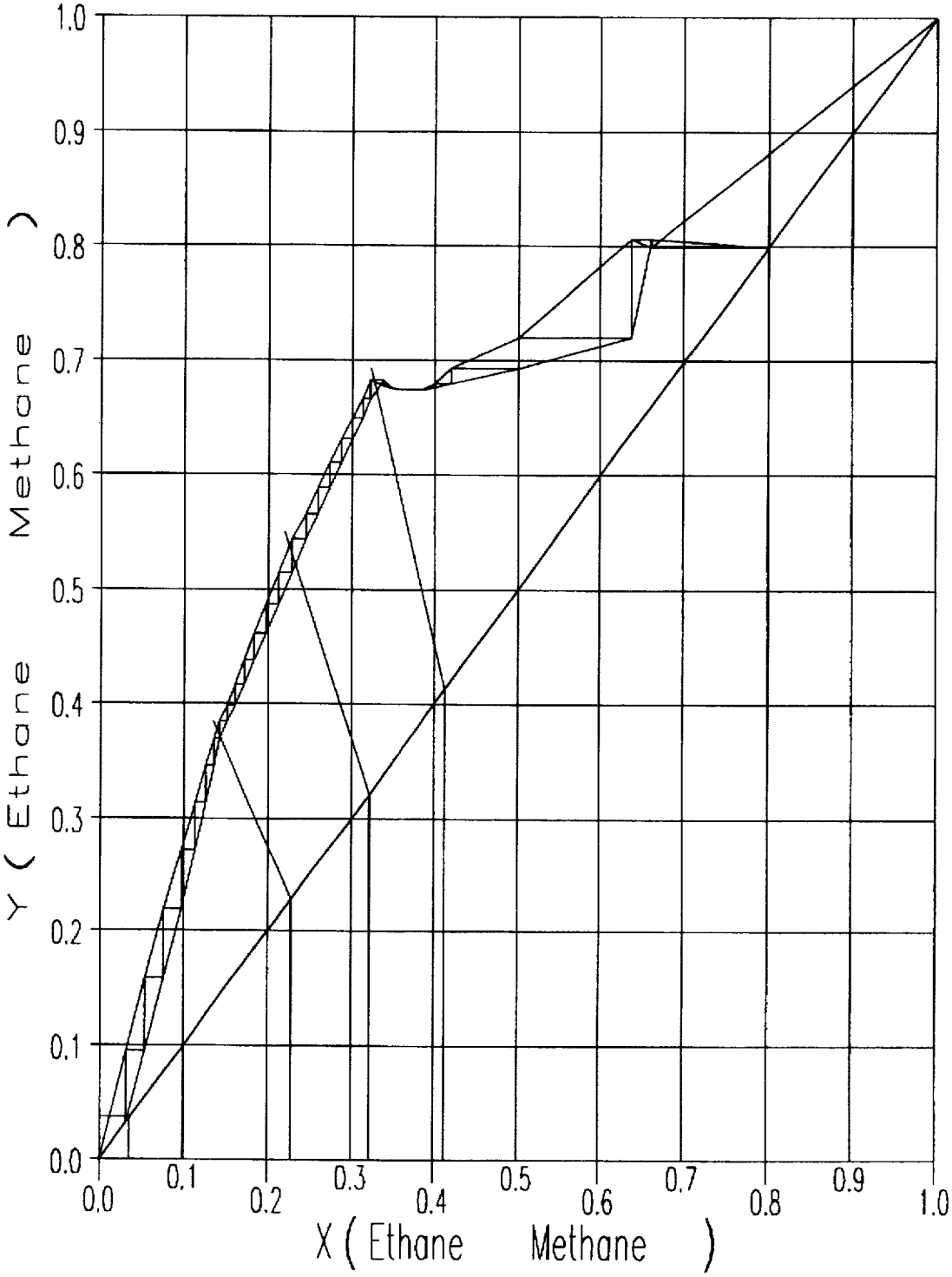

FIG. 4C shows a combined McCabe-Thiele diagram for the stages of column C400 and the thermomechanically integrated, deethanization stages. To meet specifications for the ethane/propane mixture overhead product the deethanizer feed must be partially vaporized in order to fractionate butanes from propane in the deethanizer stripping section. This shows up as a small flat section above the column feed in FIG. 4C.

Figure 4D:
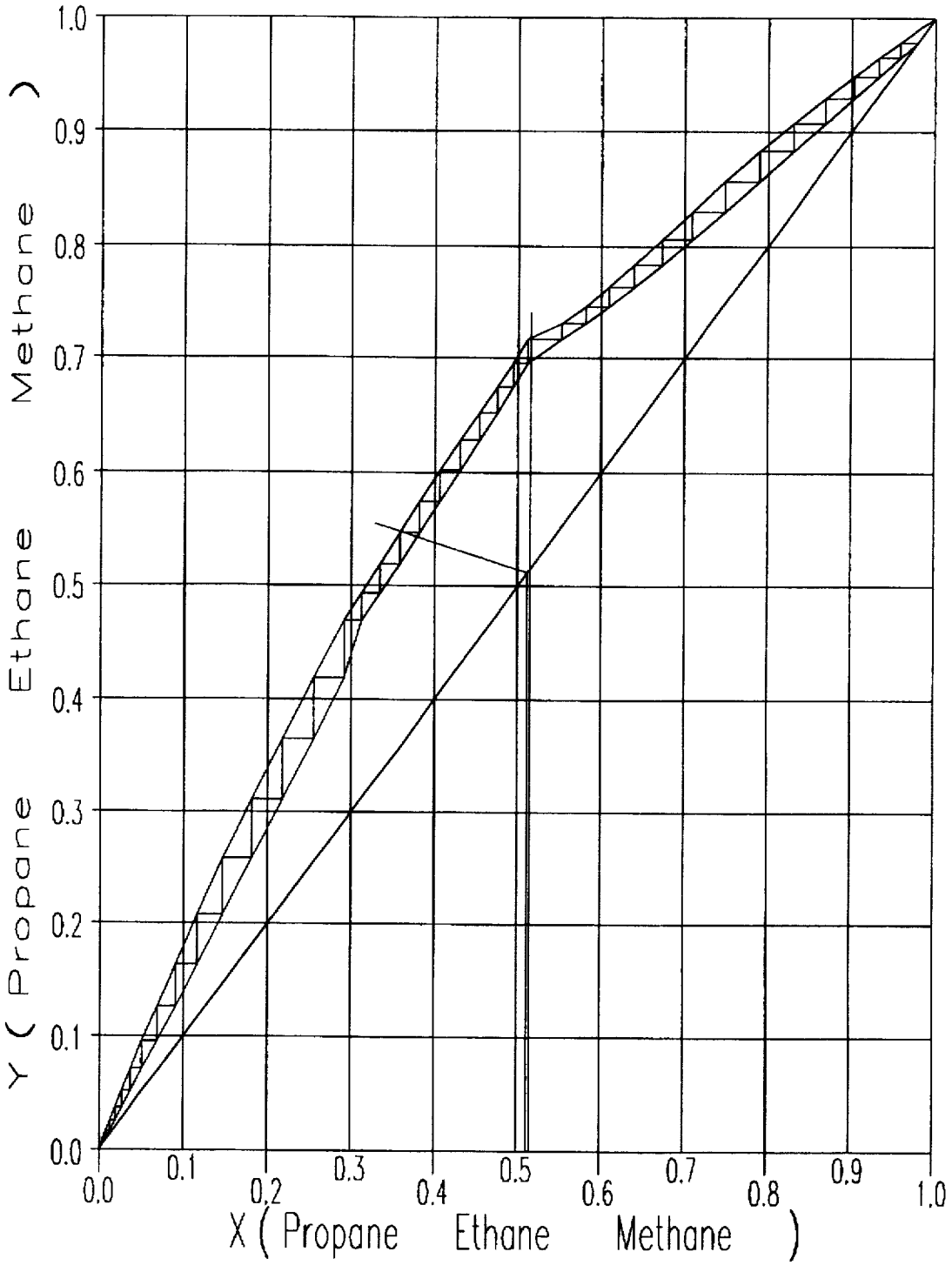

FIG. 4D shows a McCabe-Thiele diagram for column C401, which also supplies the reboil vapor for the upstream deethanizer in stream 420. A single partial interreboiler, exchanger E406, is used on column C401. An additional partial interreboiler could be added to column C401 to more fully recover heat from stream 422. The additional partial interreboiler will reduce steam consumption even further.

The feed to column C401 (stream 419, the bottoms liquid product of column C400), contains over 50 mole percent propane. The comparable bottom product stream described in example 3, stream 302, contains less than 40 mole percent propane. This increase in propane concentration results from thermal coupling and thermomechanical integration of column C400 and contributes significantly to the overall process efficiency.

EXAMPLE 5

Deethanizer/Depropanizer Sequence (Ethane Product)

Figure 5A:
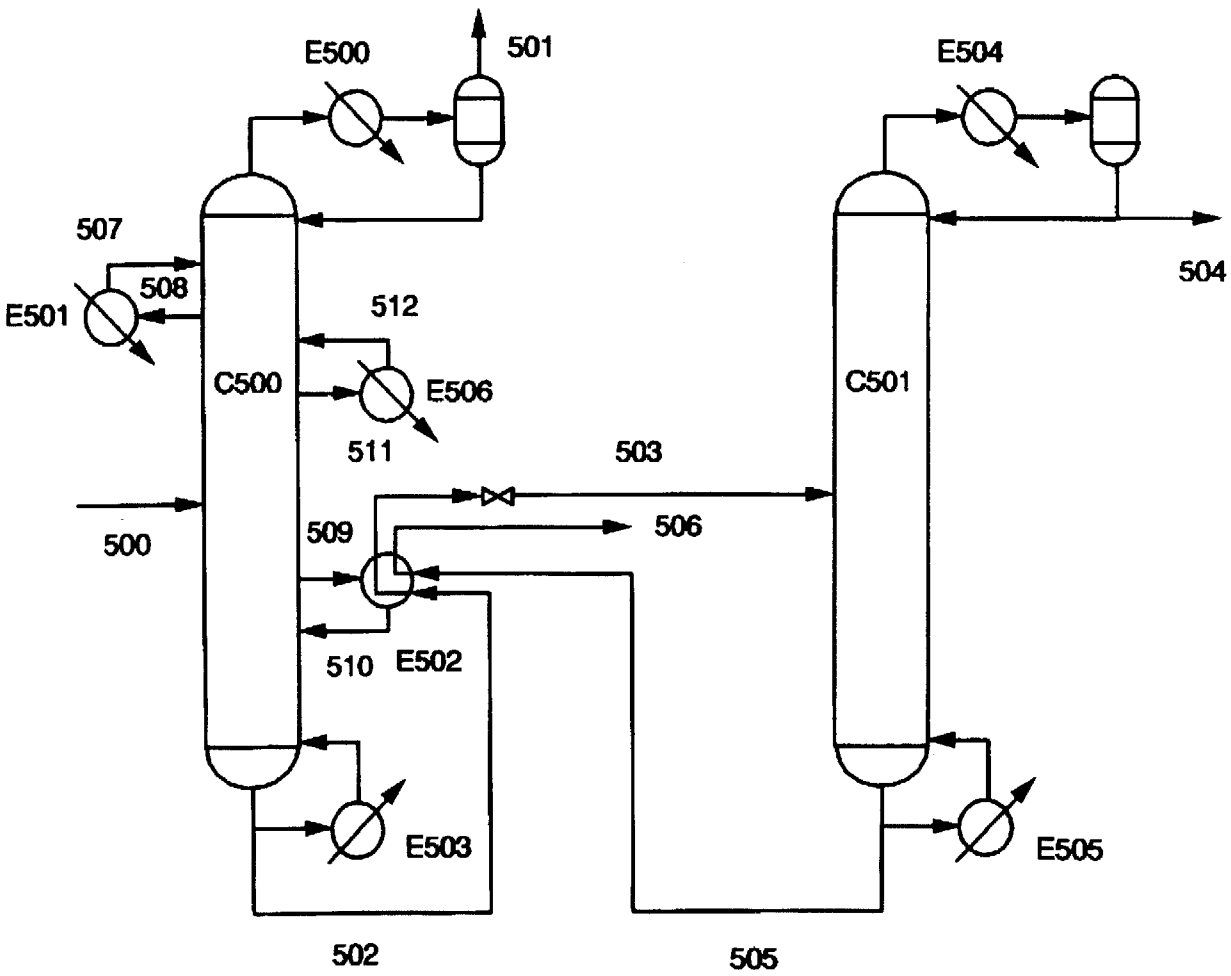
FIG. 5A is similar to FIG. 3A in showing a deethanizer/depropanizer fractionation sequence. The fractionation efficiency is significantly improved by the use of two intercondensers in the rectification section of the deethanizer.

FIG. 5A shows an NGL deethanizer/depropanizer fractionation sequence which is fed with a NGL feed containing butanes and gasoline in addition to the ethane and propane. An ethane product is obtained as the overhead vapor product of a deethanizer. The process is similar to that shown in FIG. 3A, although the product specifications for the deethanizer are changed to require greater separation of ethane from propane. The ethane product, the propane product and the butanes and gasoline stream are cooled and pumped to battery limits conditions. Targeted (energy balanced, but not heat integrated) steam, cooling water, and propane refrigeration utility processes are included in order to estimate the total energy requirements.

Table 5 gives compositions and conditions for the following streams:

| Stream No. | Stream Description |
|---|---|
| 500 | NGL deethanizer feed with butanes/gasoline |
| 501 | overhead vapor product (ethane) from deethanizer, column C500 |
| 502 | bottoms liquid product from deethanizer, column C500 |
| 503 | subcooled bottoms liquid product from column C500, feed to column C501 |
| 504 | overhead liquid product from column C501 |
| 505 | bottoms liquid product from column C501 |
| 506 | subcooled bottom liquid product from column C501 |
| 507 | partially condensed vapor sidedraw to stage 8/column C500 |
| 508 | vapor sidedraw from stage 8/column C500 |
| 509 | liquid sidedraw from stage 31/column C500 |
| 510 | partially vaporized liquid sidedraw to stage 31/column C500 |
| 511 | vapor sidedraw from stage 15/column C500 |
| 512 | partially condensed vapor sidedraw to stage 15/column C500 |

In FIG. 5A, the deethanizer, column C500, produces an overhead vapor product (ethane) which is partially condensed in a condenser, exchanger E500, to provide reflux to the top of column C500. The depropanizer, column C501, produces an overhead vapor stream which is fully condensed in a condenser, exchanger E504. Table 5 provides duties for the exchangers shown in FIG. 5A. The other exchangers are exchangers E501 (an upper intercondenser for column E500), E502 (an interreboiler for column C500), E503 (reboiler for column C500), E505 (reboiler for column C501) and E506 (a lower intercondenser for column C500). Column C500 comprises about 39 theoretical stages, with stream 500 fed to column C500 at about 22 stages from the top of stage column C500. Column C500 operates at about 450 psia.

Analogous to stream 303 of FIG. 3A, stream 503, having been first subcooled in exchanger E502, is then flashed and fed to column C501 at about stage 12. Column C501 is about 30 stages and operates at about 250 psia.

Figure 5B:
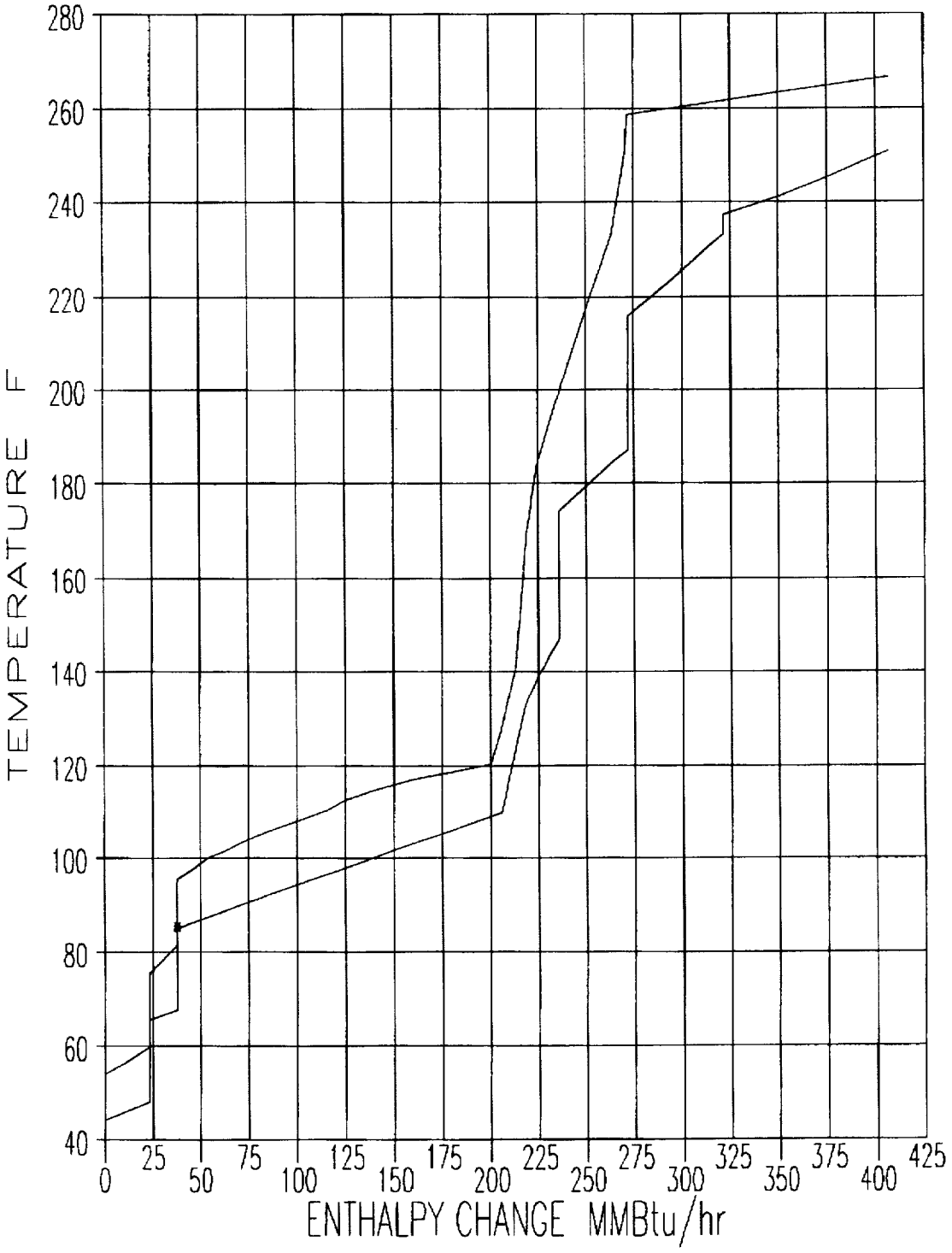

FIG. 5B shows the composite heating and cooling curves for the process and utilities in the system used to effect the deethanization and depropanization shown in FIG. 5A. The definition of the system is the equipment shown on FIG. 5A, as well as associated equipment and utilities necessary for production of utilities for the equipment shown in FIG. 5A (not shown). It is well understood by the skilled person that refrigeration and heating utilities are obtained by operation of commonly available and well defined equipment. Because the decision to implement significant process changes depends on the overall impact of utilities, a broader summation of energy requirements is most helpful in evaluating the embodiments of the present invention.

The following conclusions are obtainable from the composite heating and cooling curve of FIG. 5B. For production of streams 501,504 and 506 from 100M BPD of feed, stream 500, in the present example, a total of about 407.4 MMBtu/Hr are transferred within the system, 146.4 Mlbs of high pressure steam are required and 8.3 MMBtu/Hr of excess turbine power are generated. The excess power results from an imbalance in the high and low pressure steam requirements because of the relatively low reboiler temperatures of about 250° F. It is assumed that the process is isolated so that only high pressure (450 psig and 600° F.) steam is available, and it is expanded to low pressure through power generating turbines. The deethanizer, column C500, is calculated to have rectifying and stripping section diameters of about 12 feet and 15 feet respectively. The depropanizer, column C501, is calculated to have rectifying and stripping section diameters of about 12 feet and 14 feet, respectively.

Figure 5C:
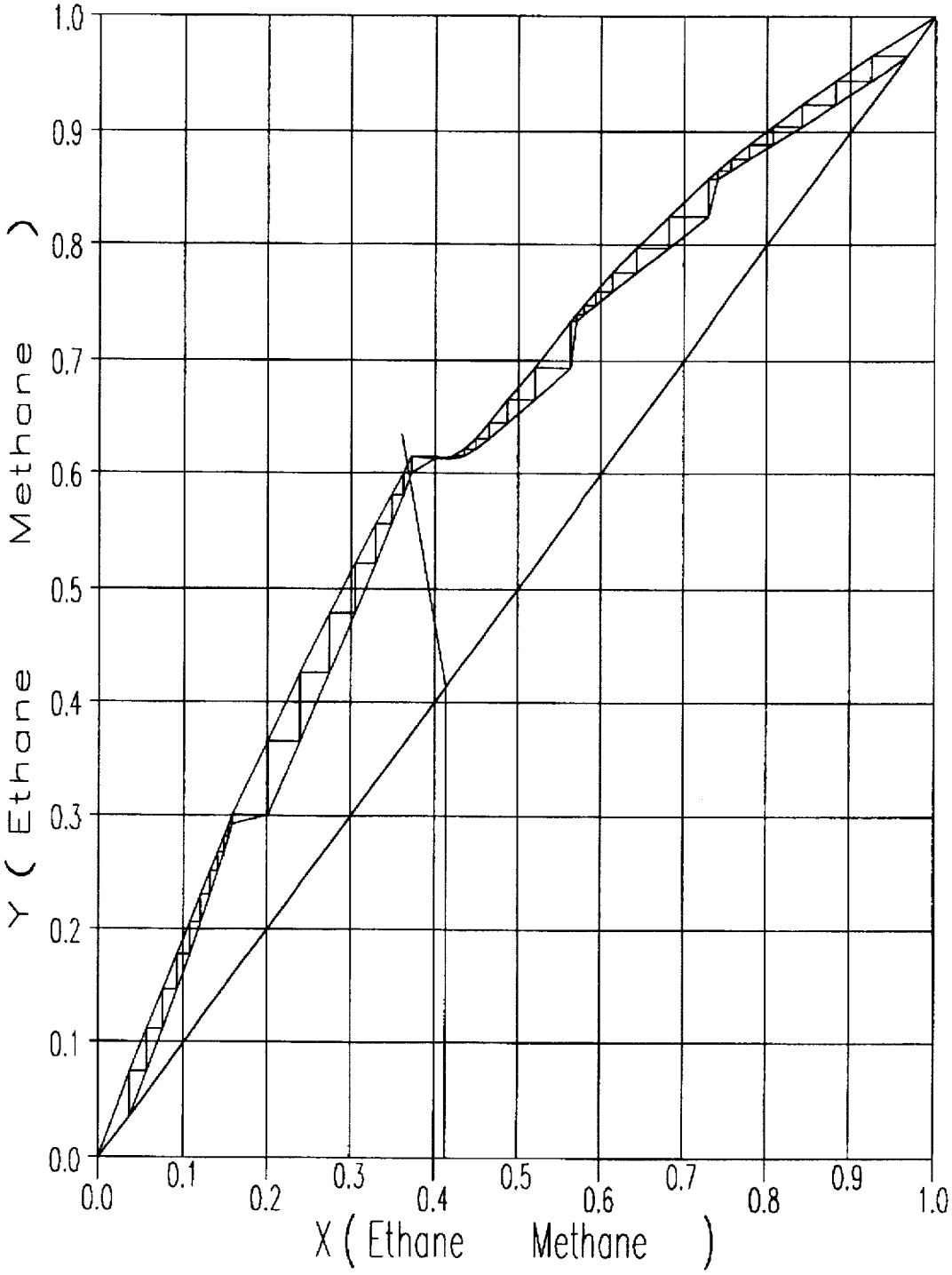

FIG. 5C shows a McCabe-Thiele diagram for the deethanizer, column C500, which includes two intercondensers, exchangers E501 and E502, and an interreboiler, exchanger E502. The feed to the deethanizer, stream 500, is partially vaporized.

Figure 5D:
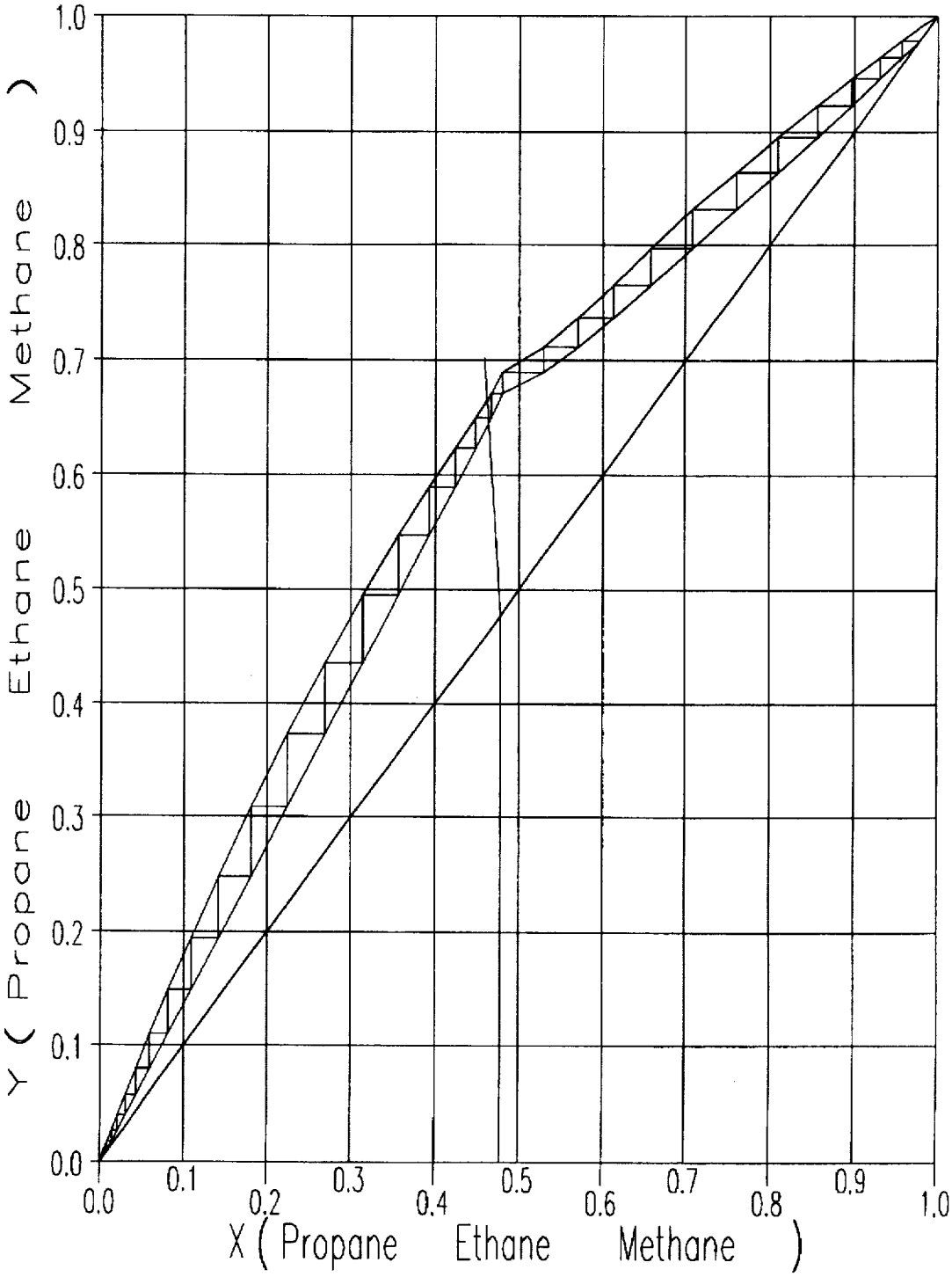

FIG. 5D shows a McCabe-Thiele diagram for the depropanizer, column 0501.

EXAMPLE 6

Thermomechanically Integrated Deethanizer (Ethane Product)

Figure 6A:
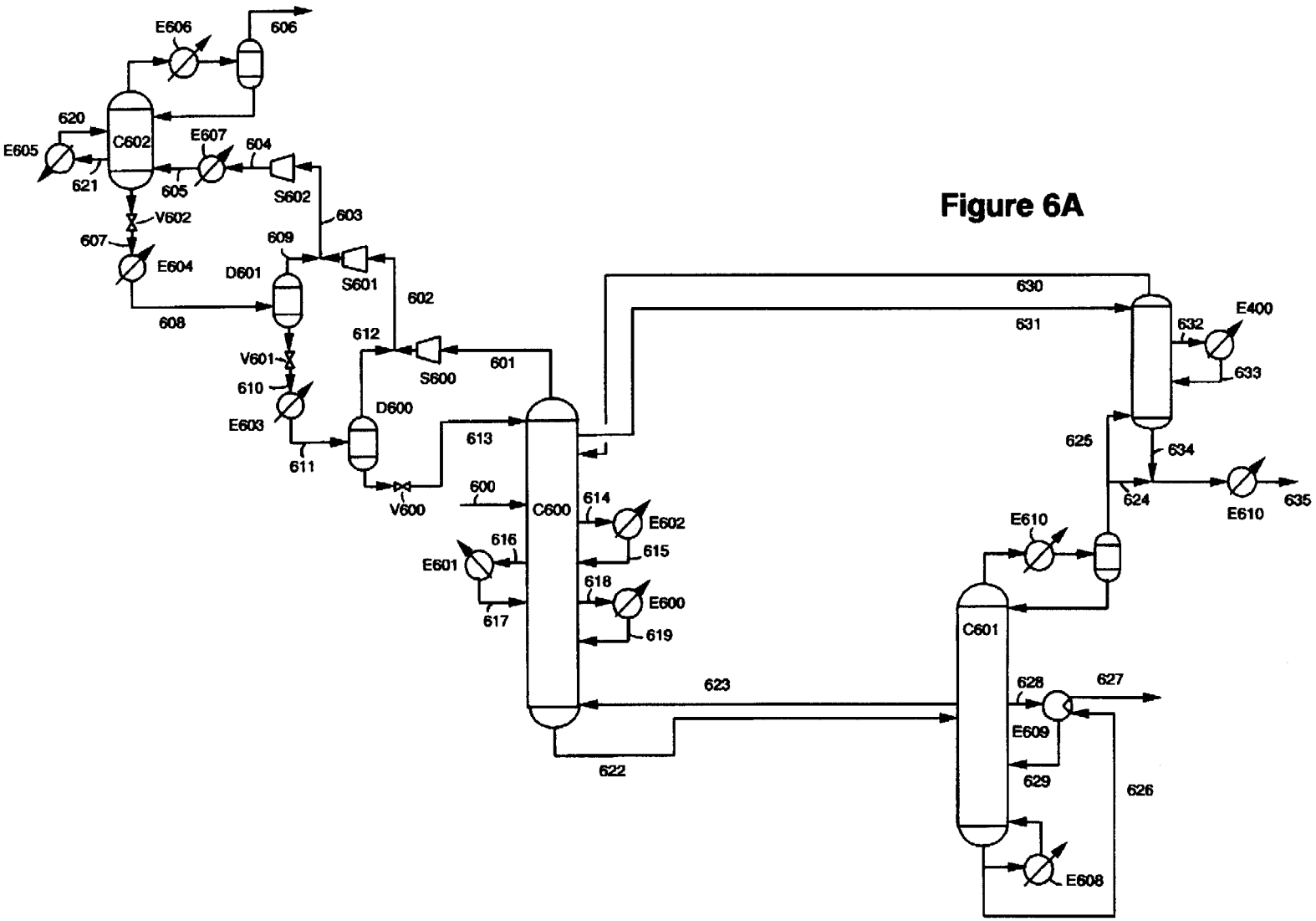
FIG. 6A shows an improvement to the fractionation sequence of FIG. 5A. Overall, the fractionation sequence of FIG. 6A shows a deethanizing fractionation to make an ethane product, a depropanizing fractionation to make a propane product, and production of a butanes and heavier stream. A penultimate set of rectification stages of the deethanizing fractionation are integrated and coupled by application of "thermomechanical" concepts, similar to those shown in FIG. 4A. The top most stages of the deethanization are refluxed and intercondensed. In addition, three thermal couplings are shown integrating the deethanizing and depropanizing fractionation for NGL feed. First, a deethanizer is thermally coupled to a side stripper. Second, the side stripper is indirectly linked with a depropanizer, i.e., part of the depropanizer overhead vapor product is shown as providing reboiling vapor to the side stripper. Third, a sidedraw vapor from the o depropanizer is shown as providing reboiling vapor to the deethanizer. Interreboilers are shown applied to both the deethanizer and the depropanizer.

FIG. 6A shows a propane distributor column thermally coupled to both a depropanizer and a thermomechanically integrated set of deethanization stages. In addition, a lower column in the thermomechanically integrated set of deethanization stages is reboiled with part of the overhead vapor product of the depropanizer.

For the process shown in FIG. 6A, an NGL feed is first fractionated in the propane distributor column. The propane distributor column is unique to a deethanization and depropanization sequence for NGL processing. About 30 percent of the propane to be recovered in the propane product is permitted to leave the propane distributor column in its overhead vapor stream. In the prior art deethanizer, none of the recoverably propane would be allowed to leave the deethanizer with the ethane product. The overhead vapor stream of the propane distributor column is then fed to the lower column of the thermomechanically integrated deethanization stages. The depropanizer of this example is significantly changed over the depropanizer of that shown in example 5. The depropanizer of the present example provides reboiling duty not only for the depropanizer and the propane distribution column. The depropanizer of the present example also reboils the lower column of the thermomechanically integrated set of deethanization stages with a portion of the depropanizer's overhead vapor product. On the other hand, the refluxing for the propane distributor column and the lower column of the thermomechanically integrated set of deethanization stages is provided a liquid stream from the compression and condensation stages of the thermomechanically integrated set of deethanization stages.

An overhead vapor stream of the lower column is compressed in three compression stages, and the partially condensed vapor from the highest pressure compression stage is fed to the bottom of an upper column in the thermomechanically integrated deethanization stages. The upper column is intercondensed and refluxed, generating an overhead vapor product, the ethane product. The upper column is associated with three water cooled exchangers. An overhead condenser and intercondenser generate reflux directly to the upper column and a partial condenser cools the bottom stage feed to the upper column. That bottom stage feed is the stream from the third compression stage of the thermomechanical compression means.

The bottoms liquid product of the interreboiled propane distributor column is fed to a depropanizer. A vapor sidedraw from the depropanizer is fed to the bottom of the propane distributor column to provide reboiling duty. The overhead vapor product of the depropanizer is split. Part of the vapor product is fed to the bottom of the lower column of the thermomechanically integrated deethanization stages and the rest is condensed to become part of the liquid propane product. The rest of the liquid propane product is obtained as the net bottoms liquid stream from the lower column of the thermomechanically integrated deethanization stages. The bottoms liquid product of the depropanizer, a butanes and heavier stream, is cooled while recovering heat to a depropanizer interreboiler. The process products are cooled and pumped to battery limits conditions. Targeted (energy balanced, but not heat integrated) steam and cooling water utility processes are included in order to estimate the energy requirements. Table 6 gives compositions and conditions for the following streams:

| Stream No. | Stream Description |
|---|---|
| 600 | NGL propane distributor column feed with butanes/gasoline |
| 601 | overhead vapor stream from propane distributor, column C600 |
| 602 | compressed vapor stream from stage S600 |
| 603 | compressed vapor stream from stage S601 |
| 604 | compressed vapor stream from stage S602 |
| 605 | partially condensed stream from exchanger E607 |
| 606 | overhead vapor product (ethane product) of column C602 |
| 607 | liquid bottoms product of column C602, flashed at valve V602 |
| 608 | further vaporized stream 607 from exchanger E604 |
| 609 | vapor portion of stream 608 |
| 610 | liquid portion of stream 609, flashed at valve V601 |
| 611 | further vaporized stream 610 from exchanger E603 |
| 612 | vapor portion of stream 611 |
| 613 | liquid portion of stream 611, flashed at valve V600 |
| 614 | liquid sidedraw for interreboiling from stage 12/column C600 |
| 615 | partially vaporized liquid sidedraw return to stage 19/column C600 |
| 616 | liquid sidedraw for interreboiling from stage 19/column C600 |
| 617 | partially vaporized liquid sidedraw return to stage 26/column C600 |
| 618 | liquid sidedraw for interreboiling from stage 26/column C600 |
| 619 | partially vaporized liquid sidedraw return to stage 33/column C600 |
| 620 | partially condensed vapor sidedraw to stage 7/column C602 |
| 621 | vapor sidedraw from stage 7/column C602 |
| 622 | bottoms liquid product from column C600 to column C601 |
| 623 | vapor sidedraw from stage 14/column C601 to bottom of column C600 |
| 624 | part of vapor overhead product from column C601 to propane product |
| 625 | part of vapor overhead product from column C601 to bottom of column C603 |
| 626 | liquid bottoms product from column C601 |
| 627 | subcooled bottoms liquid product from C601 |
| 628 | liquid sidedraw for interreboiling from stage 14/column C601 |

-continued

| Stream No. | Stream Description |
|---|---|
| 629 | partially vaporized liquid sidedraw return to stage 24/column C601 |
| 630 | overhead vapor stream from column C600 to stage 3/column 603 |
| 631 | liquid sidedraw from stage 3/column C603 to top of column C600 |
| 632 | liquid sidedraw for interreboiling from stage 10/column C603 |
| 633 | partially vaporized liquid sidedraw return to stage 10/column C603 |
| 634 | bottoms liquid stream from column C603 |
| 635 | liquid propane product from exchanger E611 |

In FIG. 6A, the propane distributor column, column C600, comprises about 40 stages, with a feed stage for stream 600 at stage 12. Partial interreboilers, exchangers E600, E601 and E602, partially vaporize liquid sidedraws and return the streams to column C600. The depropanizer, C601, comprises 37 stages, with a feed stage for stream 622 at stage 14. The partial interreboiler, exchanger E609, partially vaporizes a liquid sidedraw and returns the partially vaporized stream to column C601. Column C601 has an associated overhead condenser, exchanger E610, and a reboiler, exchanger E608.

The lower deethanizer column, column C603 comprises 18 stages, wherein stage 3 is a feed stage for stream 630. A liquid sidedraw, stream 631, is withdrawn from stage 3 of column C603 and is fed to the top stage of column C600. The partial interreboiler, exchanger E612, partially vaporizes a liquid sidedraw and returns the partially vaporized stream to column C603. The upper deethanizer column, column C602, comprises 14 stages, wherein it receives a vapor feed to its bottom stage. The intercondenser, exchanger E605, partially condenses a vapor sidedraw and returns the partially condensed stream to column C602. An overhead condenser for column C602, exchanger E606, provides reflux for the column. The locations of withdrawal and return stages of the intercondensers and interreboilers, and the duties therefor, have been optimized for a highly efficient operation and are not intended as specific limitations of the present invention. As shown in the McCabe-Thiele diagrams of this and the other examples, the location on the diagram of sections with relatively wide separation between the operating and equilibrium lines often indicates that an intercondenser or interreboiler could advantageously be used at that section of fractionation stages.

Table 6 provides duties for the exchangers shown in FIG. 6A. The other exchangers in FIG. 6A are exchangers E607 (an cooling water condenser for partially condensing vapor from the highest level of compression, stage S602) and E611 (a condenser for combined propane product streams 624 and 634). Valves V600, V601 and V602 are valves across with pressure is suddenly reduced for liquid streams from their upstream drums.

In the FIG. 6A, columns C600, C601 and C603 operate at about 250 psia. Column C602 operates at over about 500 psia. Column C600 is at least partly reboiled using a vapor side draw stream, stream 623, from the downstream depropanizer, column C601. This thermal coupling reduces the work of separation required in the depropanizer, as described above in example 2.

The stripping sections of columns C600, C601 and C603 are partially interreboiled to improve the process energy efficiency and reduce the column diameters (i.e., see exchangers E600, E601, E602, E609 and E612 in FIG. 6A). For the partial interreboilers, in contrast to the interreboilers of the prior art, withdrawal and return of sidedraws spans a relatively large number of stages. In the present example, exchangers E600, E601, E602 and E606 span 7, 7, 6 and 10 stages, respectively. The present inventor has found that this method of partial interreboiling reduces the temperature of the reboiler feeds so that process heat integration is more easily achieved by making available better approach temperatures for heat transfer. It is preferable to recover as much heat as possible from the bottom liquid products of fractionation columns, as shown for stream 626 where heat is transferred to the partial interreboiler, exchanger E609.

The deethanization stages in FIG. 6A include those of column C602 and C603 as well as those stages where separation takes place in the compression, condensing and separation steps of the thermomechanical section above column C603. The thermomechanical integration includes a three stage compressor system, stages S600, S601 and S602, to compress the column C603 overhead vapor stream, stream 601, from about 250 psia to about 500 psia. Drums D600 and D601 dually function as additional deethanizing rectification stages and refrigeration separation drums. Two liquid streams, streams 607 and 610 flashed across valves V602 and V601 respectively, are used as a refrigerants.

The following heat integrations are very important to obtain one of the most efficient embodiments of this example 6. Exchanger E605 is preferably cooled by heat transfer with the streams described as passing through exchangers E604 and E613. Exchanger E606 is preferably cooled by heat transfer with the stream described as passing through exchanger E603. As discussed above, the water cooling done in the rectification section deethanization stages results in generation of refrigerant streams that will be used to replace the need for any externally generation refrigeration.

Figure 6B:
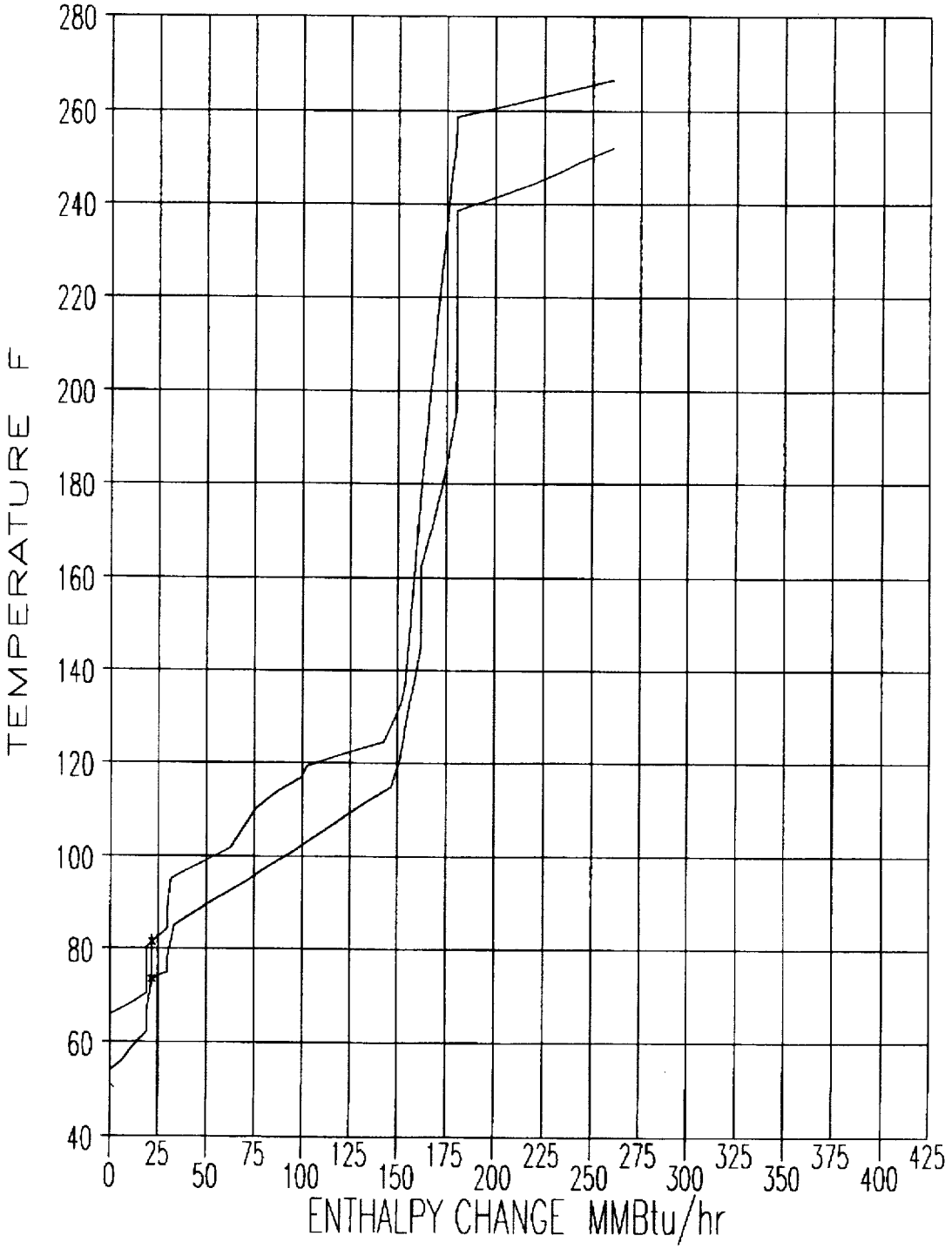

FIG. 6B shows the composite heating and cooling curves for the thermomechanically integrated process and utilities. For 100 MBPD of feed, stream 600, a total of about 256.2 MMBtu/Hr are transferred, 87.4 Mlbs of high pressure steam are required, and a deficit of 7.5 MMBtu/Hr of turbine power is consumed. These results are, respectively, 36% and 40% less than heat transferred and steam required over the system represented by FIG. 5A. However, a small amount of power must now be purchased or generated from downstream processing. The diameters of the propane distributor column, column C600, rectifying and stripping sections are about 9.5 feet and 10.5 feet, respectively. The diameters of the depropanizer, column C601, rectifying and stripping section diameters are about 10.5 feet and 14 feet respectively. Except for the depropanizer stripping section these are significant reductions over the column diameters required in the process represented by FIG. 5A. The diameter of column C602 is about 10 feet. The diameter of column C603 is about 5 feet.

Figure 6C:
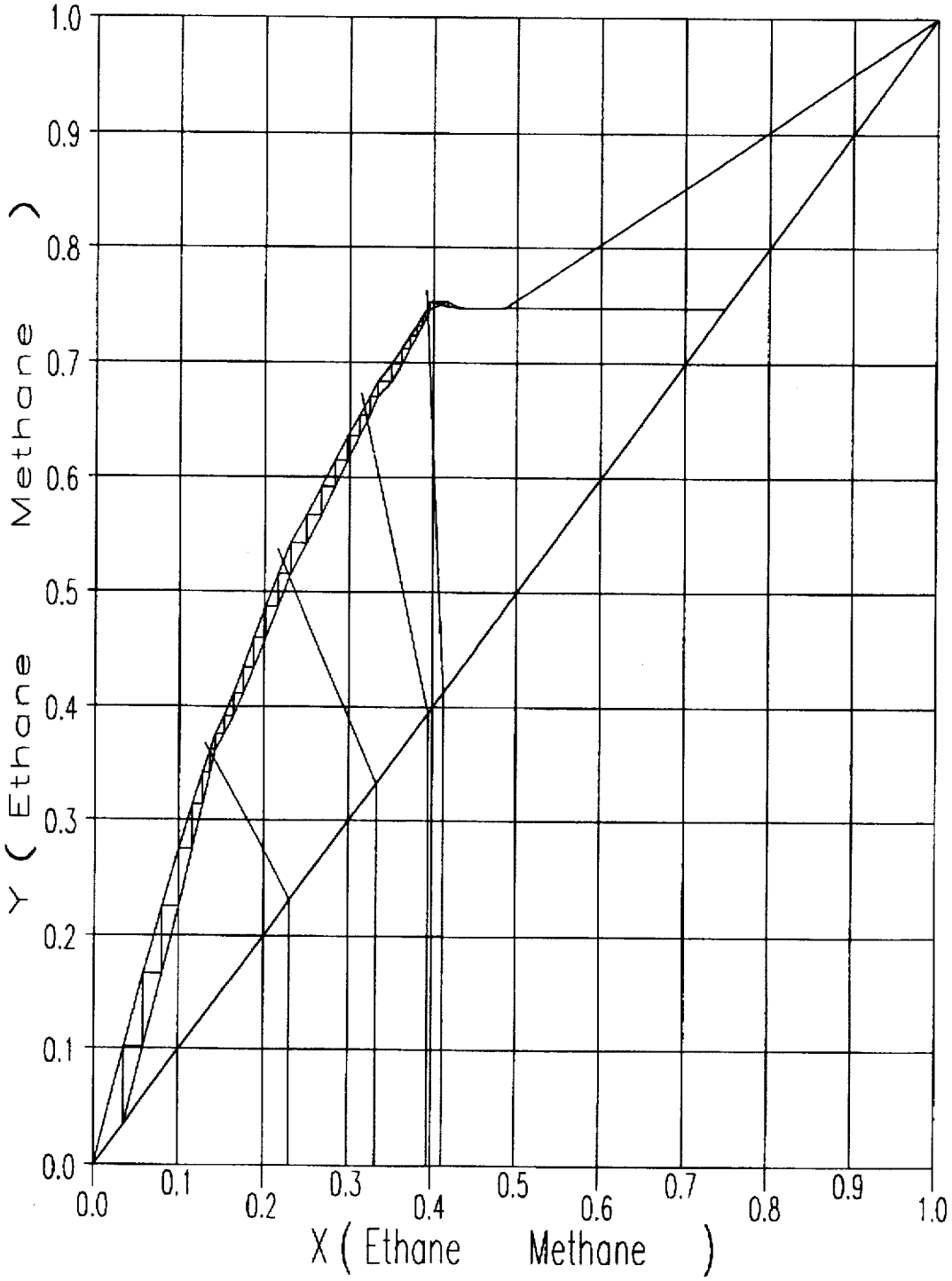
FIG. 6C shows a McCabe-Thiele diagram for the propane distribution stages represented in FIG. 6A as column C600.
Figure 6D:
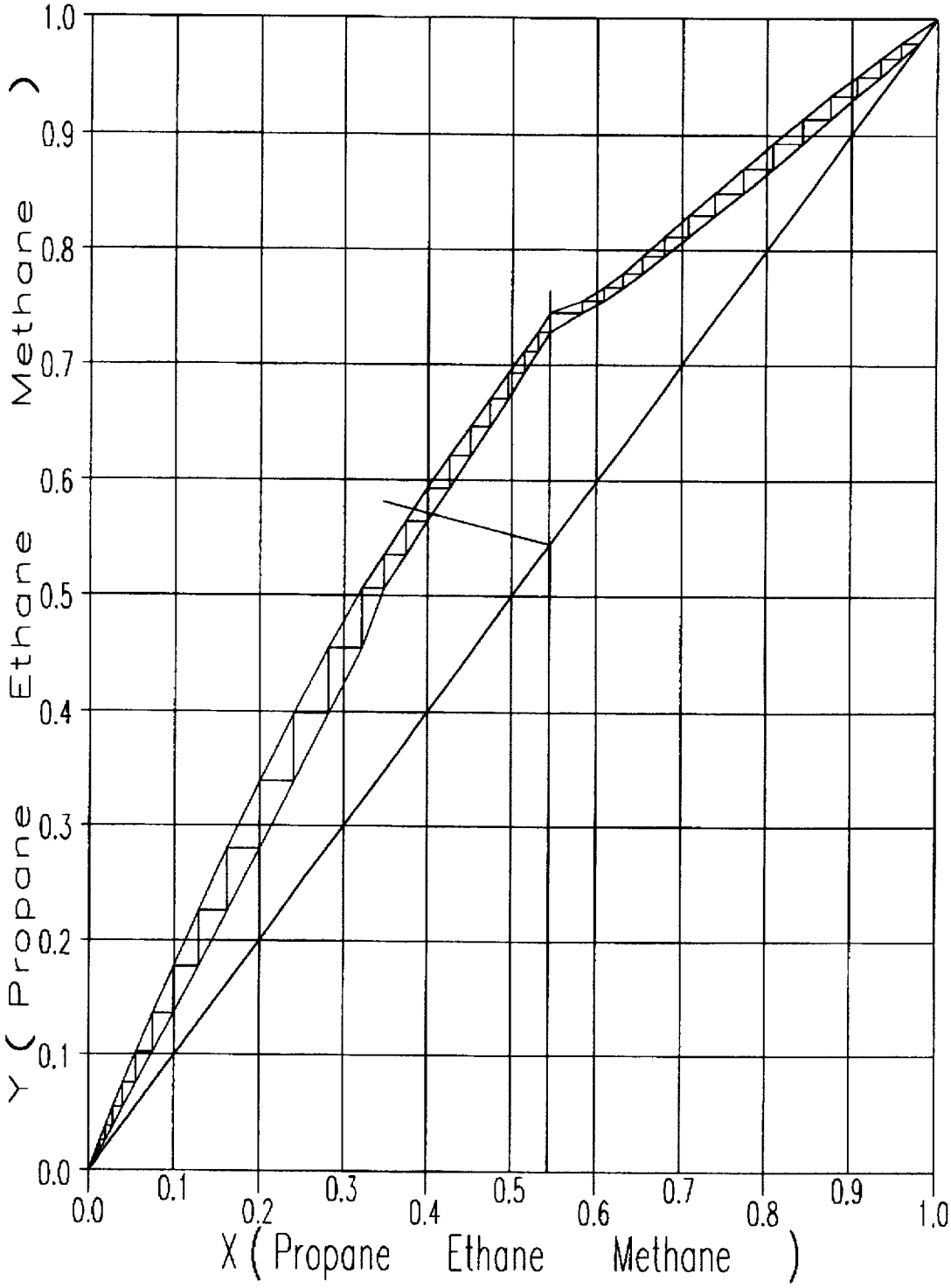
FIG. 6D shows a McCabe-Thiele diagram for the depropanizer, column C601, in FIG. 6A.
Figure 6E:
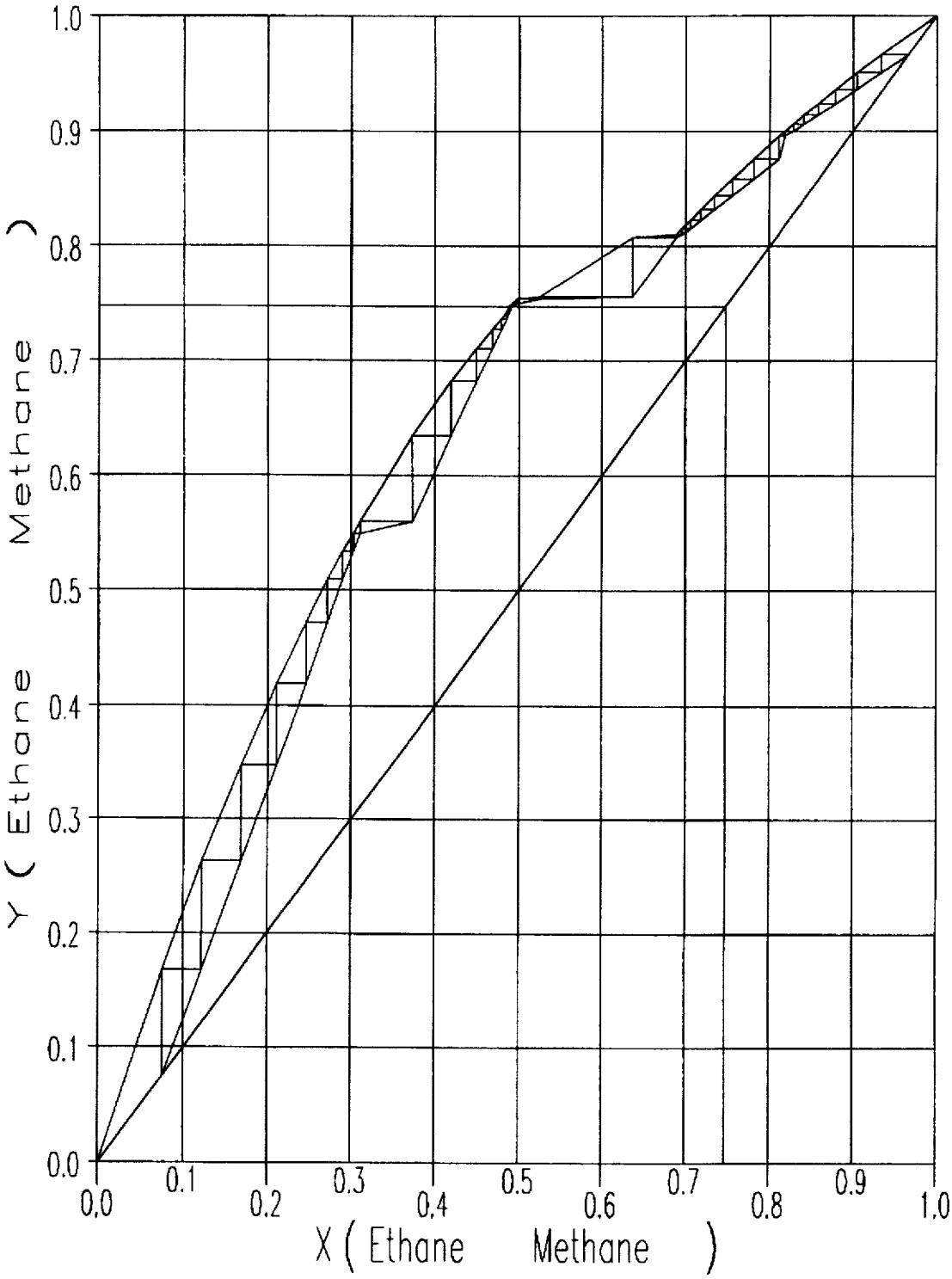
FIG. 6E shows a McCabe-Thiele diagram for deethanization stages represented in the equipment shown in FIG. 6A as column C602, C603 and the associated streams and equipment shown in FIG. 6A as process steps between columns C602 and C603. The referenced equipment identified as performing process steps between columns C602 and C603 include especially compressor stages S600, S601, and S602 (and their associated drums and valves) and exchangers E603, E604 and E607.

FIG. 6C shows a combined McCabe-Thiele diagram for propane distributor column, column C600. FIG. 6D shows a McCabe-Thiele diagram for the depropanizer, column C601. FIG. 6E shows a McCabe-Thiele diagram for the thermomechanically integrated deethanization stages, columns C602 and C603 and the intermediate compression stages and associated drums, valves and heat exchangers.

In contrast to the present invention, the thermomechanically integrated deethanizer, both the condenser(s) and reboiler(s) in the prior art thermomechanically integrated C2 splitter operate below ambient temperature and a separate, incremental, refrigeration system is required to remove the small work of compression. Heat pumped distillation columns work, if at all, best for separating close boiling mixtures. In contrast to that teaching, the ethane/propane mixtures separated in the above examples are not close boiling components. The thermomechanically integrated ethane/ethylene splitter of the prior art is special kind of heat pumped system since the condenser exchanges heat directly with the interreboiler and reboiler. The thermomechanically integrated deethanizer of the present invention is not heat pumped since the condenser and reboiler differ widely in temperature. The thermomechanical integration of the present invention is highly advantageous because the condenser or intercondenser at the upper deethanization stages is cooled with cooling water, thereby avoiding refrigeration.

Economic viability is a temporal assessment of the costs and benefits. The embodiments of the present invention currently permit significant financial return and are economically viable in large part due to the consequences of low pressure operation of the deethanization stages. Comparatively wide boiling components (such as ethane and propane) have not been the subject of high efficiency innovations in separations due to the perceived lack of economic viability in implementation. The present inventor has perceived the above embodiments as improvements in capital and utilities costs over conventional processes.

The deethanization stages of this example 6 produce an overhead vapor product stream. It is another embodiment of this example to compress that overhead vapor product stream to a relatively high pressure (as described in Table 7 as product specifications) for pipeline shipment to downstream users, wherein the compression stages (typically two) are situated or mounted on the same shaft as the thermomechanical compression stages. Thus, capital is reduced and turbine efficiency is improved with a single instead of separate compressor drivers. The number of compressor drivers is reduced for this example compared to the case described in example 5.

The above description of thermomechanical integration means in relation to NGL separation of ethane and propane from butanes and heavier are not specific limitations to the concept of the present invention. One or more mechanical compression stages may be used to thermomechanically inegrate the rectification section of deethanization stages as specifically described above. Other specific teachings concerning numbers of separation stages in the several columns and withdrawal and feed stages are optimized for those examples and teach the skilled person that other choices may be made concerning those and other design choices while still obtaining the objects of the present invention.

As indicated above, the specific examples herein are optimized for obtaining a currently desirable purity in ethane, propane and ethane/propane product mixtures. An increase or decrease in product purity or thermodynamic efficiency are within the objects of the present invention while still using the concepts of the present invention, such (1) as low pressure thermal coupling of deethanization or propane distribution stages with depropanization stages or (2) thermomechanical integration of the rectification section of deethanization stages. Optimizing choices the many design options will occur to the skilled person upon disclosure of the above examples. Such design options include, but are not limited to, location of feed and sidedraw stages, the number and pressure levels of the compression stages, temperature levels and duties of refrigeration loads imposed on the thermomechanical integration stages, the number of stages in a column or supplementation of thermal coupling refluxing or reboiling with additional condensers/intercondensers or reboilers/interreboilers. Those design options will sometimes present the designer with considerable and wide ranges from which to choose appropriate process modifications for the above examples. However, the objects of the present invention will still be obtained by the skilled person applying such design options in an appropriate manner.

TABLE 1

| Stream | 100 | 101 | 102 | 103 | 104 |
|---|---|---|---|---|---|
| Vap. Frac. | 0.0000 | 1.0000 | 0.0000 | 0.0000 | 0.0000 |
| Deg. F | 132.5 | 56.1 | 232.8 | 111.9 | 253.1 |
| psia | 455.0 | 449.3 | 456.5 | 253.8 | 262.5 |
| lbmole/hr | 15,803 | 6,398 | 9,405 | 4,567 | 4,838 |
| Mlb/hr | 708.41 | 193.51 | 514.90 | 197.90 | 317.00 |
| barrel/day | 100,000 | 36,784 | 63,216 | 27,264 | 35,952 |
| Vol. Frac. | | | | | |
| Methane | 0.0050 | 0.0136 | 0.0000 | 0.0000 | 0.0000 |
| Ethane | 0.3700 | 0.9513 | 0.0318 | 0.0736 | 0.0000 |
| Propane | 0.2600 | 0.0350 | 0.3909 | 0.9014 | 0.0038 |
| i-Butane | 0.0720 | 0.0001 | 0.1138 | 0.0213 | 0.1840 |
| n-Butane | 0.1480 | | 0.2341 | 0.0037 | 0.4088 |
| i-Pentane | 0.0500 | | 0.0791 | | 0.1391 |
| n-Pentane | 0.0350 | | 0.0554 | | 0.0974 |
| n-Hexane | 0.0400 | | 0.0633 | | 0.1113 |
| n-Heptane | 0.0200 | | 0.0316 | | 0.0556 |
| Exchanger | E100 | E101 | E102 | E103 | |
| MMBtu/hr | 50.20 | 98.87 | 89.66 | 74.27 | |

TABLE 2

| Stream | 200 | 201 | 202 | 203 | 204 | 205 |
|---|---|---|---|---|---|---|
| Vap. Frac. | 0.0526 | 1.0000 | 0.0000 | 0.0000 | 0.0000 | 1.0000 |
| Deg. F | 76.7 | 15.3 | 140.9 | 108.8 | 253.1 | 146.5 |
| psia | 258.8 | 253.1 | 259.9 | 253.8 | 262.5 | 260.0 |
| lbmole/hr | 15,803 | 6,296 | 22,027 | 4,672 | 4,835 | 12,519 |
| Mlb/hr | 708.41 | 190.38 | 1088.37 | 201.17 | 316.86 | 570.35 |
| barrel/day | 100,000 | 36,191 | 140,269 | 27,871 | 35,938 | 76,460 |
| Vol. Frac. | | | | | | |
| Methane | 0.0050 | 0.0138 | 0.0000 | 0.0000 | 0.0000 | 0.0000 |
| Ethane | 0.3700 | 0.9512 | 0.0488 | 0.0924 | 0.0000 | 0.0558 |
| Propane | 0.2600 | 0.0350 | 0.6007 | 0.8826 | 0.0039 | 0.7785 |
| i-Butane | 0.0720 | 0.0000 | 0.0838 | 0.0188 | 0.1857 | 0.0596 |
| n-Butane | 0.1480 | 0.0000 | 0.1513 | 0.0062 | 0.4070 | 0.0841 |
| i-Pentane | 0.0500 | 0.0000 | 0.0420 | 0.0000 | 0.1391 | 0.0116 |
| n-Pentane | 0.0350 | 0.0000 | 0.0285 | 0.0000 | 0.0974 | 0.0065 |
| n-Hexane | 0.0400 | 0.0000 | 0.0302 | 0.0000 | 0.1113 | 0.0031 |
| n-Heptane | 0.0200 | 0.0000 | 0.0147 | 0.0000 | 0.0557 | 0.0007 |
| Exchanger | E200 | E201 | E202 | | | |
| MMBtu/hr | 31.55 | 55.80 | 144.68 | | | |

TABLE 3

| Stream | 300 | 301 | 302 | 303 | 304 | 305 | 306 | 307 | 308 | 309 | 310 |
|---|---|---|---|---|---|---|---|---|---|---|---|
| Vap. Frac. | 0.1900 | 1.0000 | 0.0000 | 0.0729 | 0.0000 | 0.0000 | 0.0000 | 1.0000 | 0.6227 | 0.0000 | 0.2812 |
| Deg. F. | 146.7 | 85.8 | 248.3 | 186.0 | 95.0 | 251.2 | 196.5 | 107.4 | 95.0 | 186.5 | 200.9 |
| psia | 455.0 | 444.0 | 457.6 | 260.0 | 248.9 | 257.3 | 252.3 | 454.3 | 449.3 | 455.7 | 456.2 |
| lbmole/hr | 15,803 | 7,886 | 7,917 | 7,917 | 3,100 | 4,817 | 4,817 | 15,883 | 15,883 | 20,438 | 20,438 |
| Mlb/hr | 708.41 | 258.29 | 450.12 | 450.12 | 134.32 | 315.80 | 315.80 | 550.76 | 550.76 | 1011.31 | 1011.31 |
| barrel/day | 100,000 | 45,685 | 54,315 | 54,315 | 18,506 | 35,809 | 35,809 | 92.822 | 92.822 | 132,257 | 132,257 |
| Vol. Frac. | | | | | | | | | | | |
| Methane | 0.0050 | 0.0109 | 0.0000 | 0.0000 | 0.0000 | 0.0000 | 0.0000 | 0.0067 | 0.0067 | 0.0000 | 0.0000 |
| Ethane | 0.3700 | 0.7800 | 0.0251 | 0.0251 | 0.0738 | 0,0000 | 0.0000 | 0.6676 | 0.6676 | 0.1597 | 0.1597 |
| Propane | 0.2600 | 0.2011 | 0.3096 | 0.3096 | 0.9012 | 0.0038 | 0.0038 | 0.2975 | 0.2975 | 0.3886 | 0.3886 |
| i-Butane | 0.0720 | 0.0056 | 0.1278 | 0.1278 | 0.0210 | 0.1830 | 0.1830 | 0.0173 | 0.0173 | 0.1046 | 0.1046 |
| n-Butane | 0.1480 | 0.0024 | 0.2705 | 0.2705 | 0.0040 | 0,4082 | 0.4082 | 0.0108 | 0.0108 | 0.2002 | 0.2002 |
| i-Pentane | 0.0500 | | 0.0921 | 0.0921 | | 0.1396 | 0.1396 | 0.0001 | 0.0001 | 0.0553 | 0.0553 |
| n-Pentane | 0.0350 | | 0.0644 | 0.0644 | | 0.0977 | 0.0977 | 0.0000 | 0.0000 | 0.0372 | 0.0372 |
| n-Hexane | 0.0400 | | 0.0736 | 0.0736 | | 0.1117 | 0.1117 | 0.0000 | 0.0000 | 0.0371 | 0.0371 |
| n-Heptane | 0.0200 | | 0.0368 | 0.0368 | | 0.0559 | 0.0559 | 0.0000 | 0.0000 | 0.0171 | 0.0171 |
| Stream | E300 | E301 | E302 | E303 | E304 | E305 | | | | | |
| MMBtu/hr | 8.69 | 25.90 | 32.17 | 41.72 | 68.90 | 71.57 | | | | | |

TABLE 4

| Stream | 400 | 401 | 402 | 403 | 404 | 405 | 406 | 407 | 408 | 409 |
|---|---|---|---|---|---|---|---|---|---|---|
| Vap. Frac. | 0.2450 | 1.0000 | 1.0000 | 1.0000 | 1.0000 | 0.3718 | 1.0000 | 0.0000 | 0.0000 | 0.1409 |
| Deg. F. | 92.5 | 63.0 | 100.3 | 115.3 | 136.9 | 94.8 | 94.8 | 74.5 | 90.0 | 80.2 |
| psia | 255.0 | 253.7 | 350.0 | 420.0 | 511.0 | 506.0 | 506.0 | 501.0 | 1314.7 | 420.0 |
| lbmole/hr | 15,803 | 12,200 | 12,200 | 19,253 | 21,119 | 21,119 | 7,878 | 7,878 | 7,878 | 13,241 |
| Mlb/hr | 708.41 | 419.83 | 419.83 | 659.85 | 720.77 | 720.77 | 257.82 | 257.82 | 257.82 | 462.96 |
| barrel/day | 100,000 | 71,153 | 71,153 | 112,297 | 123,111 | 123,111 | 45,635 | 45,635 | 45,635 | 77,479 |
| Vol. Frac. | | | | | | | | | | |
| Methane | 0.0050 | 0.0073 | 0.0073 | 0.0060 | 0.0064 | 0.0064 | 0.0110 | 0.0110 | 0.0110 | 0.0036 |
| Ethane | 0.3700 | 0.6766 | 0.6766 | 0.6885 | 0.6974 | 0.6974 | 0.7812 | 0.7812 | 0.7812 | 0.6481 |
| Propane | 0.2600 | 0.2986 | 0.2986 | 0.2904 | 0.2819 | 0.2819 | 0.2010 | 0.2010 | 0.2010 | 0.3296 |
| i-Butane | 0.0720 | 0.0157 | 0.0157 | 0.0135 | 0.0128 | 0.0128 | 0.0063 | 0.0063 | 0.0063 | 0.0167 |
| n-Butane | 0.1480 | 0.0019 | 0.0019 | 0.0016 | 0.0015 | 0.0015 | 0.0006 | 0.00006 | 0.0006 | 0.0020 |
| i-Pentane | 0.0500 | | | | | | | | | |
| n-Pentane | 0.0350 | | | | | | | | | |
| n-Hexane | 0.0400 | | | | | | | | | |
| n-Heptane | 0.0200 | | | | | | | | | |

| Stream | 410 | 411 | 412 | 413 | 414 | 415 | 416 | 417 | 418 | 419 |
|---|---|---|---|---|---|---|---|---|---|---|
| Vap. Frac. | 1.0000 | 0.1066 | 0.6219 | 1.0000 | 0.1456 | 0.0000 | 0.3081 | 0.0000 | 0.3712 | 0.0000 |
| Deg. F. | 80.2 | 66.5 | 80.1 | 80.7 | 57.8 | 93.0 | 120.0 | 114.4 | 145.0 | 162.8 |
| psia | 420.0 | 350.0 | 347.0 | 350.0 | 253.7 | 255.0 | 254.4 | 255.7 | 255.1 | 257.1 |
| lbmole/hr | 1,866 | 11,375 | 11,375 | 7,053 | 4,322 | 4,660 | 4,660 | 4,602 | 4,602 | 12,976 |
| Mlb/hr | 60.92 | 402.04 | 402.04 | 240.01 | 162.03 | 220.77 | 220.77 | 228.28 | 228.28 | 693.50 |
| barrel/day | 10,814 | 66,665 | 66,665 | 41,144 | 25,522 | 30,000 | 30,000 | 30,000 | 30,000 | 86,014 |
| Vol. Frac. | | | | | | | | | | |
| Methane | 0.0100 | 0.0026 | 0.0026 | 0.0038 | 0.0008 | 0.0009 | 0.0009 | 0.0001 | 0.0001 | 0.0000 |
| Ethane | 0.7895 | 0.6251 | 0.6251 | 0.7092 | 0.4895 | 0.2874 | 0.2874 | 0.2021 | 0.2021 | 0.0283 |
| Propane | 0.1942 | 0.3515 | 0.3515 | 0.2761 | 0.4731 | 0.2815 | 0.2815 | 0.3231 | 0.3231 | 0.4335 |
| i-Butane | 0.0057 | 0.0185 | 0.0185 | 0.0099 | 0.0325 | 0.0888 | 0.0888 | 0.0990 | 0.0990 | 0.1232 |
| n-Butane | 0.0005 | 0.0022 | 0.0022 | 0.0010 | 0.0042 | 0.1807 | 0.1807 | 0.2004 | 0.2004 | 0.2311 |
| i-Pentane | | | | | | 0.0567 | 0.0567 | 0.0622 | 0.0622 | 0.0661 |
| n-Pentane | | | | | | 0.0392 | 0.0392 | 0.0429 | 0.0429 | 0.0452 |
| n-Hexane | | | | | | 0.0434 | 0.0434 | 0.0472 | 0.0472 | 0.0487 |
| n-Heptane | | | | | | 0.0214 | 0.0214 | 0.0232 | 0.0232 | 0.0238 |

| Stream | 420 | 421 | 422 | 423 | 424 | 425 |
|---|---|---|---|---|---|---|
| Vap. Frac. | 1.0000 | 0.0000 | 0.0000 | 0.0000 | 0.0000 | 0.8099 |
| Deg. F. | 166.1 | 95.0 | 252.3 | 176.1 | 166.1 | 197.6 |
| psia | 257.2 | 250.9 | 260.0 | 255.0 | 257.2 | 256.2 |
| lbmole/hr | 5,051 | 3,100 | 4,825 | 4,825 | 3,033 | 3,033 |
| Mlb/hr | 242.89 | 134.34 | 316.28 | 316.28 | 161.26 | 161.26 |
| barrel/day | 31,645 | 18,504 | 35,864 | 35,864 | 20,000 | 20,000 |
| Vol. Frac. | | | | | | |
| Methane | 0.0000 | 0.0000 | 0.0000 | 0.0000 | 0.0000 | 0.0000 |
| Ethane | 0.0342 | 0.0731 | 0.0000 | 0.0000 | 0.0109 | 0.0109 |
| Propane | 0.6465 | 0.9019 | 0.0038 | 0.0038 | 0.4512 | 0.4512 |
| i-Butane | 0.1165 | 0.0215 | 0.1818 | 0.1818 | 0.1433 | 0.1433 |
| n-Butane | 0.1614 | 0.0035 | 0.4101 | 0.4101 | 0.2429 | 0.2429 |
| i-Pentane | 0.0216 | | 0.1394 | 0.1394 | 0.0576 | 0.0576 |
| n-Pentane | 0.0123 | | 0.0976 | 0.0976 | 0.0383 | 0.0383 |
| n-Hexane | 0.0060 | | 0.1115 | 0.1115 | 0.0379 | 0.0379 |
| n-Heptane | 0.0014 | | 0.0558 | 0.0558 | 0.0178 | 0.0178 |

| Stream | E400 | E401 | E402 | E403 | E404 | E405 | E406 | E407 |
|---|---|---|---|---|---|---|---|---|
| MMBtu/hr | 13.26 | 10.81 | 62.43 | 27.89 | 1.00 | 51.83 | 17.22 | 75.92 |

TABLE 5

| Stream | 500 | 501 | 502 | 503 | 504 | 505 | 506 | 507 | 508 | 509 | 510 | 511 | 512 |
|---|---|---|---|---|---|---|---|---|---|---|---|---|---|
| Vap Frac. | 0.1900 | 1.0000 | 0.0000 | 0.0798 | 0.0000 | 0.0000 | 0.0000 | 1.0000 | 0.7864 | 0.0000 | 02751 | 1.0000 | 0.7729 |
| Deg. F. | 146.7 | 54.1 | 233.1 | 172.6 | 95.0 | 251.0 | 184.3 | 101.5 | 95.5 | 174.3 | 187.1 | 81.3 | 75.6 |
| psia | 455.0 | 438.1 | 457.6 | 260.0 | 248.9 | 257.3 | 252.3 | 454.3 | 449.3 | 455.7 | 456.2 | 448.7 | 443.7 |
| lbmole/hr | 15,803 | 6,397 | 9,406 | 9,406 | 4,567 | 4,838 | 4,838 | 19,586 | 19,586 | 24,777 | 24,777 | 15,847 | 15,847 |
| Mlb/hr | 708.41 | 193.49 | 514.93 | 514.93 | 197.90 | 317.03 | 317.03 | 670.92 | 670.92 | 1179.52 | 1179.52 | 513.02 | 513.02 |

TABLE 5-continued

| Stream | 500 | 501 | 502 | 503 | 504 | 505 | 506 | 507 | 508 | 509 | 510 | 511 | 512 |
|---|---|---|---|---|---|---|---|---|---|---|---|---|---|
| barrel/day | 100,000 | 36,781 | 63,219 | 63,219 | 27,263 | 35,956 | 35,956 | 114,064 | 114,064 | 157,581 | 157,581 | 91,845 | 91,845 |
| Vol. Frac. | | | | | | | | | | | | | |
| Methane | 0.0050 | 0.0136 | 0.0000 | 0.0000 | 0.0000 | 0.0000 | 0.0000 | 0.0057 | 0.0057 | 0.0000 | 0.0000 | 0.0069 | 0.0069 |
| Ethane | 0.3700 | 0.9514 | 0.0317 | 0.0317 | 0.0736 | 0.0000 | 0.0000 | 0.6813 | 0.6813 | 0.1825 | 0.1825 | 0.8132 | 0.8132 |
| Propane | 0.2600 | 0.0350 | 0.3909 | 0.3909 | 0.9014 | 0.0038 | 0.0038 | 0.3111 | 0.3111 | 0.4494 | 0.4494 | 0.1799 | 0.1799 |
| i-Butane | 0.0720 | | 0.1139 | 0.1139 | 0.0207 | 0.1845 | 0.1845 | 0.0014 | 0.0014 | 0.0866 | 0.0866 | | |
| n-Butane | 0.1480 | | 0.2341 | 0.2341 | 0.0043 | 0.4084 | 0.4084 | 0.0006 | 0.0006 | 0.1617 | 0.1617 | | |
| i-Pentane | 0.0500 | | 0.0791 | 0.0791 | | 0.1391 | 0.1391 | | | 0.0448 | 0.0448 | | |
| n-Pentane | 0.0350 | | 0.0554 | 0.0554 | | 0.0973 | 0.0973 | | | 0.0302 | 0.0302 | | |
| n-Hexane | 0.0400 | | 0.0633 | 0.0633 | | 0.1112 | 0.1112 | | | 0.0304 | 0.0304 | | |
| n-Heptane | 0.0200 | | 0.0316 | 0.0316 | | 0.0556 | 0.0556 | | | 0.0142 | 0.0142 | | |
| Exchanger | E500 | E501 | E502 | E503 | E504 | E505 | E506 | | | | | | |
| MMBtu/hr | 23.41 | 17.30 | 36.27 | 49.75 | 83.15 | 85.58 | 14.31 | | | | | | |

TABLE 6

| Stream | 600 | 601 | 602 | 603 | 604 | 605 | 606 | 607 | 608 | 609 |
|---|---|---|---|---|---|---|---|---|---|---|
| Vap. Frac. | 0,0582 | 1.0000 | 1.0000 | 1.0000 | 1.0000 | 0.6586 | 1.0000 | 0,1969 | 0.3031 | 1.0000 |
| Deg. F. | 75.9 | 50.6 | 67.8 | 96.8 | 133.1 | 95.0 | 65.8 | 73.3 | 74.9 | 74.9 |
| psia | 255.0 | 248.7 | 295.0 | 395.0 | 526.2 | 521.2 | 510.0 | 398.0 | 395.0 | 395.0 |
| lbmole/hr | 15,803 | 12,337 | 17,853 | 22,834 | 22,834 | 22,834 | 6,390 | 16,437 | 16,437 | 4,982 |
| Mlb/hr | 708.41 | 411.64 | 596.09 | 758.75 | 758.75 | 758.75 | 193.26 | 565.26 | 565.26 | 162.66 |
| barrel/day | 100,000 | 71,645 | 103,759 | 132,672 | 132,672 | 132,672 | 36,738 | 95,889 | 95,889 | 28.912 |
| Vol. Frac. | | | | | | | | | | |
| Methane | 0.0050 | 0.0072 | 0.0057 | 0.0056 | 0.0056 | 0.0056 | 0.0136 | 0.0026 | 0.0026 | 0.0054 |
| Ethane | 0.3700 | 0.7405 | 0.7428 | 0.7546 | 0.7546 | 0.7546 | 0.9514 | 0.6791 | 0.6791 | 0.7971 |
| Propane | 0.2600 | 0.2518 | 0.2511 | 0.2394 | 0.2394 | 0.2394 | 0,0350 | 0.3178 | 0.3178 | 0.1973 |
| i-Butane | 0.0720 | 0.0005 | 0.0004 | 0.0004 | 0.0004 | 0.0004 | | 0.0006 | 0.0006 | 0.0002 |
| n-Butane | 0.1480 | | | | | | | | | |
| i-Pentane | 0.0600 | | | | | | | | | |
| n-Pentane | 0.0360 | | | | | | | | | |
| n-Hexane | 0.0400 | | | | | | | | | |
| n-Heptane | 0.0200 | | | | | | | | | |

| Stream | 610 | 611 | 612 | 613 | 614 | 615 | 616 | 617 | 618 | 619 |
|---|---|---|---|---|---|---|---|---|---|---|
| Vap. Frac. | 0.1434 | 0.4815 | 1.0000 | 0.0722 | 0.0000 | 0.2251 | 0.0000 | 0.3650 | 0.0000 | 0.4250 |
| Deg. F. | 54.1 | 62.2 | 62.2 | 50.2 | 77.8 | 95.0 | 90.4 | 120.0 | 111.7 | 145.0 |
| psia | 298.0 | 295.0 | 295.0 | 248.7 | 254.3 | 253.6 | 255.0 | 254.4 | 255.7 | 255.1 |
| lbmole/hr | 11,455 | 11,455 | 5,515 | 5,940 | 5,518 | 5,518 | 4,690 | 4,690 | 4,631 | 4,631 |
| Mlb/hr | 402.61 | 402.61 | 184.45 | 218.15 | 249.09 | 249.09 | 218.58 | 218.58 | 226.76 | 226.77 |
| barrel/day | 66,977 | 66,977 | 32,115 | 34,862 | 35,000 | 35,000 | 30,000 | 30,000 | 30,000 | 30,001 |
| Vol. Frac. | | | | | | | | | | |
| Methane | 0.0013 | 0.0013 | 0.0023 | 0.0004 | 0.0011 | 0.0011 | 0.0001 | 0.0001 | 0.0000 | 0.0000 |
| Ethane | 0.6281 | 0.6281 | 0.7479 | 0.5178 | 0.3588 | 0.3588 | 0.3014 | 0.3014 | 0.2068 | 0.2068 |
| Propane | 0.3698 | 0.3698 | 0.2495 | 0.4807 | 0.2707 | 0.2707 | 0.2999 | 0.2999 | 0.3470 | 0.3470 |
| i-Butane | 0.0007 | 0.0007 | 0.0003 | 0.0011 | 0.0772 | 0.0772 | 0.0838 | 0.0838 | 0.0946 | 0.0946 |
| n-Butane | | | | 0.0001 | 0.1541 | 0.1541 | 0.1667 | 0.1667 | 0.1874 | 0.1874 |
| i-Pentane | | | | | 0.0486 | 0.0486 | 0.0523 | 0.0523 | 0.0582 | 0.0582 |
| n-Pentane | | | | | 0.0336 | 0.0336 | 0.0361 | 0.0361 | 0.0401 | 0.0401 |
| n-Hexane | | | | | 0.0374 | 0.0374 | 0,0400 | 0.0400 | 0.0442 | 0.0442 |
| n-Heptane | | | | | 0.0185 | 0.0185 | 0.0198 | 0.0198 | 0.0218 | 0.0218 |

| Stream | 620 | 621 | 622 | 623 | 624 | 625 | 626 | 627 | 628 | 629 |
|---|---|---|---|---|---|---|---|---|---|---|
| Vap. Frac. | 1,0000 | 0.7914 | 0.0000 | 1.0000 | 1.0000 | 1.0000 | 0.0000 | 0.0000 | 0.0000 | 0.8426 |
| Deg. F. | 84.3 | 80.4 | 159.0 | 162.5 | 119.4 | 119.4 | 252.1 | 172.5 | 162.5 | 195.7 |
| psia | 520.6 | 515.6 | 257.1 | 257.2 | 250.9 | 250.9 | 260.0 | 255.0 | 257.2 | 256.2 |
| lbmole/hr | 15,468 | 15,468 | 13,662 | 5,227 | 2,571 | 1,025 | 4,840 | 4,840 | 3,052 | 3,052 |
| Mlb/hr | 489.64 | 489.64 | 721.78 | 248.86 | 111.39 | 44.43 | 317.10 | 317.10 | 160.42 | 160.42 |
| barrel/day | 89,485 | 89,485 | 90,016 | 32,584 | 15,346 | 6,121 | 35,964 | 35,964 | 20,000 | 20,000 |
| Vol. Frac. | | | | | | | | | | |
| Methane | 0.0074 | 0.0074 | 0.0000 | 0.0000 | 0.0000 | 0.0000 | 0.0000 | 0.0000 | 0.0000 | 0.0000 |
| Ethane | 0.8641 | 0.8641 | 0.0308 | 0.0365 | 0.0737 | 0.0737 | 0.0000 | 0.0000 | 0.0119 | 0.0119 |
| Propane | 0.1285 | 0.1285 | 0.4605 | 0.6741 | 0.9013 | 0.9013 | 0.0038 | 0.0038 | 0.4828 | 0.4828 |
| i-Butane | | | 0.1169 | 0.1056 | 0.0217 | 0.0217 | 0.1838 | 0.1838 | 0.1342 | 0.1342 |
| n-Butane | | | 0.2171 | 0.1461 | 0.0033 | 0.0033 | 0.4092 | 0.4092 | 0.2273 | 0.2273 |
| i-Pentane | | | 0.0627 | 0.0197 | | | 0.1390 | 0.1390 | 0.0546 | 0.0546 |

TABLE 6-continued

| | | | | | | | | | | |
|---|---|---|---|---|---|---|---|---|---|---|
| n-Pentane | | | 0.0429 | 0.0112 | | | 0.0973 | 0.0973 | 0.0363 | 0.0363 |
| n-Hexane | | | 0.0464 | 0 0055 | | | 0.1112 | 0.1112 | 0.0360 | 0,0360 |
| n-Heptane | | | 0 0227 | 0.0013 | | | 0.0556 | 0.0556 | 0.0170 | 0.0170 |
| Stream | 630 | 631 | 632 | 633 | 634 | 635 | | | | |
| Vap Frac. | 1,0000 | 0.0000 | 0.0000 | 0.2332 | 0.0000 | 0.0000 | | | | |
| Deg. F. | 53.6 | 51.8 | 66.7 | 74.5 | 111:0 | 87.5 | | | | |
| psia | 253.2 | 248.9 | 249.5 | 250.0 | 250.8 | 245.8 | | | | |
| lbmole/hr | 10,250 | 2,883 | 2,515 | 2,515 | 1,995 | 4.566 | | | | |
| Mlb/hr | 343.19 | 107.68 | 98.09 | 98.09 | 86.45 | 197.84 | | | | |
| barrel/day | 59,526 | 16,956 | 14,853 | 14,853 | 11,908 | 27,254 | | | | |
| Vol. Frac. | | | | | | | | | | |
| Methane | 0.0087 | 0.0011 | 0.0000 | 0.0000 | 0.0000 | 0.0000 | | | | |
| Ethane | 0.7312 | 0.4784 | 0.3656 | 0.3656 | 0.0727 | 0.0733 | | | | |
| Propane | 0.2546 | 0.5095 | 0.6222 | 0.6222 | 0.9026 | 0.9019 | | | | |
| i-Butane | 0.0049 | 0.0097 | 0.0109 | 0.0109 | 0.0216 | 0.0217 | | | | |
| n-Butane | 0.0006 | 0.0012 | 0.0013 | 0.0013 | 0.0030 | 0.0032 | | | | |
| Stream | E600 | E601 | E602 | E603 | E604 | E605 | E606 | E607 | E608 | E609 |
| MMBtu/hr | 14.98 | 12.51 | 8.56 | 19.28 | 7.18 | 10.54 | 19.28 | 43.54 | 80.83 | 17.97 |
| Stream | E610 | E611 | E612 | | | | | | | |
| MMBtu/hr | 34.47 | 17.79 | 3.36 | | | | | | | |

TABLE 7

Typical Specifications for NGL Fractionation

| Liq Vol % | Feed | Ethane | E/P Mix | Propane | Isobutane | N-Butane | Gasoline |
|---|---|---|---|---|---|---|---|
| Methane | 0.50 | | | | | | |
| Ethane | 37.00 | | 78.00 | 7.32 | | | |
| Propane | 26.00 | 3.50 | | 90.18 | 2.00 | | |
| Isobutane | 7.20 | | | | 96.00 | 4.50 | |
| N-butane | 14.80 | | | | 2.00 | 95.00 | |
| Butanes | | | 0.80 | 2.50 | | | 3.00 |
| Isopentane | 5.00 | | | | | | |
| N-pentane | 3.50 | | | | | | |
| Pentanes | | | | | | 0.50 | |
| N-hexane | 4.00 | | | | | | |
| N-heptane | 2.00 | | | | | | |
| Total | 100.00 | | | 100.00 | 100.00 | 100.00 | |
| Bttry Lmts | | | | | | | |
| Deg. F. | 85 | 90 | 100 | 100 | 100 | 100 | 100 |
| Psig | 550 | 1550 | 1300 | 1100 | 900 | 1000 | 1000 |

I claim:

1. A process for NGL fractionation comprising:

(a) deethanization stages, comprising a lower stripping section below a feed stage and an upper rectification section above a feed stage, wherein the stripping section and at least a lower portion of the rectification section are operated at low pressure;

(b) an NGL feed consisting essentially of ethane, propane and NGL hydrocarbon components equal to and greater in molecular weight than isobutane; and (c) an upper portion of the deethanization stages contains at least two compression stages, first and final compression stages, comprising:

(i) a first compressor stage wherein a vapor overhead stream from the lower portion of the rectification section is compressed and then mixed with a first drum vapor from a first drum to form a first mixed vapor;

(ii) withdrawing from the first drum a first drum liquid and flashing it to the top stage of the lower portion of the rectification section;

(iii) a final compressor stage wherein the first mixed vapor is compressed, is partially condensed and then separated in a final drum to form a final drum vapor and a final drum liquid; and (iv) flashing the final drum liquid into the first drum.

2. The process of claim 1 wherein an intermediate compression stage in interposed between the first and final compression stages comprising:

(a) the first mixed vapor is compressed in the intermediate compressor stage and is then mixed with an intermediate drum vapor to form an intermediate mixed vapor;

(b) withdrawing an intermediate drum liquid from the intermediate drum and flashing it to the first drum;

(c) the final compressor stage wherein the intermediate mixed vapor is compressed, partially condensed and then separated in the final drum to form the final drum vapor and final drum liquid; and (d) flashing the final drum liquid into the intermediate drum.

3. The process of claim 2 wherein the final drum is the bottom stage of an upper column, wherein reflux is supplied to the top stage of the upper column by an overhead condenser.

4. The process of claim 3 wherein the upper column is at least partially supplied with reflux by an intercondenser.

5. The process of claim 3 wherein a first refrigeration load is interposed between the point of flashing of the final drum liquid and the intermediate drum.

6. The process of claim 5 wherein the first refrigeration load is at least part of the cooling for the intercondenser.

7. The process of claim 3 wherein a second refrigeration load is interposed between the point of flashing of the intermediate drum liquid and the first drum.

8. The process of claim 7 wherein the second refrigeration load is at least part of the cooling for the upper column overhead condenser.

9. The process of claim 3 wherein a propane distributor column is interposed between the feed stage of the deethanization stages and a depropanizer, such that the propane distributor column receives NGL feed and the overhead vapor of the propane distributor column is fed to the feed stage of the deethanization stages.

10. The process of claim 9 wherein a liquid sidedraw from the low pressure zone of the deethanization stages is fed to the top stage of the propane distribution column.

11. The process of claim 10 wherein the overhead vapor stream from the propane distributor column contains less than about 35 percent of the propane in the NGL feed.

12. The process of claim 9 wherein the depropanizer is condensed with an overhead condenser and produces an overhead vapor product, at least a portion of which is fed to the bottom stage of the deethanization stages.

13. The process of claim 9 wherein the bottoms liquid stream of the deethanization stages and the overhead vapor product of the depropanizer comprise product specification propane and the overhead vapor product of the upper column comprises product specification ethane.

14. The process of claim 2 wherein a first refrigeration load is interposed between the point of flashing of the intermediate drum liquid and the first drum.

15. The process of claim 14 wherein the first refrigeration load is at least part of the cooling a condenser for the final drum vapor.

16. The process of claim 15 wherein the and the overhead vapor product of the depropanizer comprises product specification propane and the final drum vapor comprises product specification ethane.

17. A process for NGL fractionation comprising:

(a) deethanization stages, comprising a lower stripping section below a feed stage and an upper rectification section above a feed stage, wherein the stripping section and at least a lower portion of the upper rectification section are operated at low pressure;

(b) an NGL feed consisting essentially of ethane, propane and NGL hydrocarbon components equal to and greater in molecular weight than isobutane;

(d) feeding the NGL feed to the feed stage of deethanization stages;

(e) an upper portion of the deethanization stages contains at least two compression stages, first and final compression stages, comprising:

(i) a first compressor stage wherein a vapor overhead stream from the lower portion of the rectification section is compressed and then mixed with a first drum vapor from a first drum to form a first mixed vapor;

(ii) withdrawing from the first drum a first drum liquid and flashing it to the top stage of the lower portion of the upper rectification section;

(iii) a final compressor stage wherein the first mixed vapor is compressed, is partially condensed by indirect heat exchange and then separated in a final drum to form a final drum vapor and a final drum liquid; and (iv) flashing the final drum liquid into the first drum.

18. The process of claim 17 wherein an intermediate compression stage in interposed between the first and final compression stages comprising:

(a) the first mixed vapor is compressed in the intermediate compressor stage and is then mixed with an intermediate drum vapor to form an intermediate mixed vapor;

(b) withdrawing an intermediate drum liquid from the intermediate drum and flashing it to the first drum;

(c) the final compressor stage wherein the intermediate mixed vapor is compressed, partially condensed and then separated in the final drum to form the final drum vapor and final drum liquid; and (d) flashing the final drum liquid into the intermediate drum.

19. The process of claim 18 wherein the final drum is the bottom stage of an upper column, wherein reflux is supplied to the top stage of the upper column by an overhead condenser.

20. The process of claim 19 wherein the upper column is at least partially supplied with reflux by an intercondenser.

21. The process of claim 20 wherein a first refrigeration load is interposed between the point of flashing of the final drum liquid and the intermediate drum.

22. The process of claim 21 wherein the first refrigeration load is at least part of the cooling for the intercondenser.

23. The process of claim 19 wherein a second refrigeration load is interposed between the point of flashing of the intermediate drum liquid and the first drum.

24. The process of claim 20 wherein the second refrigeration load is at least part of the cooling for the upper column overhead condenser.

25. The process of claim 19 wherein a propane distributor column is interposed between the NGL feed and the feed stage of the deethanization stages such that the propane distributor column receives NGL feed, an overhead vapor stream from the propane distributor column contains less than about 35 percent of the propane in the NGL feed and the overhead vapor of the propane distributor column is fed to the feed stage of the deethanization stages.

26. The process of claim 25 wherein a liquid sidedraw from the low pressure zone of the deethanization stages is fed to the top stage of the propane distribution column.

27. The process of claim 26 wherein a depropanizer further fractionates a bottoms liquid stream from the propane distributor column, the depropanizer overhead vapor stream is condensed with an overhead condenser and produces an overhead vapor product, at least a portion of which is fed to the bottom stage of the deethanization stages.

28. The process of claim 27 wherein the bottoms liquid stream of the deethanization stages and the overhead vapor product of the depropanizer comprise product specification propane and the overhead vapor product of the upper column comprises product specification ethane.

29. The process of claim 18 wherein a first refrigeration load is interposed between the point of flashing of the intermediate drum liquid and the first drum.

30. The process of claim 29 wherein the first refrigeration load is at least part of the cooling a condenser for the final drum vapor.

31. The process of claim 18 wherein the final drum vapor comprises product specification ethane.

* * * * *